US006951388B2

(12) United States Patent
Sasaki

(10) Patent No.: US 6,951,388 B2
(45) Date of Patent: Oct. 4, 2005

(54) INK CARTRIDGE AND REMAINING INK VOLUME DETECTION METHOD

(75) Inventor: Toyonori Sasaki, Anjou (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/269,885

(22) Filed: Oct. 15, 2002

(65) Prior Publication Data

US 2003/0048339 A1 Mar. 13, 2003

Related U.S. Application Data

(63) Continuation of application No. 09/863,299, filed on May 24, 2001, which is a continuation of application No. 09/280,056, filed on Mar. 29, 1999, now Pat. No. 6,270,207.

(30) Foreign Application Priority Data

| | | |
|---|---|---|
| Mar. 30, 1998 | (JP) | 10-084037 |
| Apr. 7, 1998 | (JP) | 10-094772 |
| Apr. 7, 1998 | (JP) | 10-094773 |
| Apr. 7, 1998 | (JP) | 10-094774 |
| Apr. 7, 1998 | (JP) | 10-094775 |
| Apr. 7, 1998 | (JP) | 10-094776 |
| Apr. 7, 1998 | (JP) | 10-094777 |
| Apr. 7, 1998 | (JP) | 10-094778 |
| May 28, 1998 | (JP) | 10-146993 |
| Jun. 15, 1998 | (JP) | 10-166920 |
| Feb. 5, 1999 | (JP) | 11-028320 |
| Mar. 29, 1999 | (JP) | 11-87187 |

(51) Int. Cl.[7] ..... B41J 2/175
(52) U.S. Cl. ..... 347/86
(58) Field of Search ..... 347/85–87; 222/56, 222/187

(56) References Cited

U.S. PATENT DOCUMENTS

| | | | | |
|---|---|---|---|---|
| 4,968,998 A | | 11/1990 | Allen | 347/7 |
| 5,182,581 A | | 1/1993 | Kashimura et al. | 347/87 |
| 5,489,932 A | | 2/1996 | Ceschin et al. | 347/87 |
| 5,689,290 A | | 11/1997 | Saito et al. | 347/7 |
| 5,703,633 A | | 12/1997 | Gehrer et al. | 347/86 |
| 5,721,577 A | * | 2/1998 | Ostermeier et al. | 347/86 |
| 5,790,158 A | | 8/1998 | Shinada et al. | 347/86 |
| 5,877,794 A | | 3/1999 | Takagi | 347/87 |
| 5,903,294 A | | 5/1999 | Abe et al. | 347/87 |

(Continued)

FOREIGN PATENT DOCUMENTS

| | | |
|---|---|---|
| EP | 0 573 274 A2 | 12/1993 |
| EP | 0 631 874 A2 | 1/1995 |
| EP | 0 685 340 A1 | 12/1995 |
| EP | 0 765 756 A2 | 4/1997 |
| EP | 0 791 464 A2 | 8/1997 |
| JP | A-2-34349 | 2/1990 |
| JP | A-2-214666 | 8/1990 |
| JP | A-3-136866 | 6/1991 |
| JP | A-5-340791 | 12/1993 |

(Continued)

*Primary Examiner*—Michael Nghiem
(74) *Attorney, Agent, or Firm*—Oliff & Berridge, PLC

(57) ABSTRACT

An ink cartridge including a case in which an ink chamber and an atmosphere connection path are formed, the atmosphere connection path connecting the first chamber with the outside of the case, a through hole formed in the atmosphere connection path, the through hole having an end surface that faces upward, and an ink sump positioned lower than the end surface of the through hole, wherein the through hole is formed midway along the atmosphere connection path.

11 Claims, 15 Drawing Sheets

U.S. PATENT DOCUMENTS

| | | | | | |
|---|---|---|---|---|---|
| 5,905,518 | A | | 5/1999 | DeFilippis | 347/85 |
| 5,912,689 | A | * | 6/1999 | Otsuka et al. | 374/86 |
| 5,953,030 | A | | 9/1999 | Ishinaga et al. | 347/86 |
| 6,000,790 | A | | 12/1999 | Takagi et al. | 347/87 |
| 6,007,191 | A | | 12/1999 | Fujii et al. | 347/87 |
| 6,010,212 | A | | 1/2000 | Yamashita et al. | 347/86 |
| 6,010,213 | A | * | 1/2000 | Kanaya et al. | 347/87 |
| 6,024,428 | A | | 2/2000 | Uchikata | 347/7 |
| 6,164,769 | A | | 12/2000 | Inada et al. | 347/86 |
| 6,168,266 | B1 | * | 1/2001 | Ishinaga et al. | 347/86 |
| 6,247,803 | B1 | | 6/2001 | Kanaya et al. | 347/86 |
| 6,250,749 | B1 | | 6/2001 | Merz et al. | 347/86 |
| 6,254,227 | B1 | | 7/2001 | Merz et al. | 347/86 |
| 6,270,207 | B1 | * | 8/2001 | Sasaki | 347/86 |
| 6,302,532 | B1 | * | 10/2001 | Ishinaga et al. | 347/86 |
| 6,382,785 | B2 | | 5/2002 | Inada et al. | 347/86 |
| 6,450,630 | B2 | * | 9/2002 | Kanaya et al. | 347/86 |
| 6,474,796 | B1 | | 11/2002 | Ishinaga | 347/85 |
| 6,478,416 | B2 | * | 11/2002 | Ishinaga et al. | 347/86 |
| 2001/0024226 | A1 | * | 9/2001 | Sasaki | 347/86 |
| 2002/0154180 | A1 | * | 10/2002 | Uchikata | 347/7 |

FOREIGN PATENT DOCUMENTS

| | | |
|---|---|---|
| JP | A-6-040043 | 2/1994 |
| JP | A-6-226990 | 8/1994 |
| JP | A-7-060985 | 3/1995 |
| JP | A-7-89088 | 4/1995 |
| JP | A-7-089088 | 4/1995 |
| JP | A-7-132611 | 5/1995 |
| JP | A-7-276659 | 10/1995 |
| JP | A-7-314712 | 12/1995 |
| JP | A-7-323565 | 12/1995 |
| JP | A-8-025644 | 1/1996 |
| JP | A-8-132635 | 5/1996 |
| JP | A-8-174858 | 7/1996 |
| JP | A-8-197743 | 8/1996 |
| JP | A-8-207298 | 8/1996 |
| JP | A-8-216424 | 8/1996 |
| JP | A-8-323989 | 12/1996 |
| JP | A-9-29989 | 2/1997 |
| JP | A-9-70982 | 3/1997 |
| JP | A-9-085963 | 3/1997 |
| JP | A-9-136425 | 5/1997 |
| JP | A-9-141887 | 6/1997 |
| JP | A-9-174877 | 7/1997 |
| JP | A-10-016249 | 1/1998 |
| JP | A-10-058696 | 3/1998 |
| JP | A-10-067120 | 3/1998 |
| JP | A-10A-16610 | 6/1998 |
| JP | A-10-250111 | 9/1998 |

* cited by examiner

INK CARTRIDGE AND REMAINING INK VOLUME DETECTION METHOD

This is a Continuation Application of application Ser. No. 09/863,299 filed May 24, 2001 which in turn is a Continuation of application Ser. No. 09/280,056 filed Mar. 29, 1999, now U.S. Pat. No. 6,270,207 issued Aug. 7, 2001. The entire disclosure of the prior applications is hereby incorporated by reference herein in its entirety.

BACKGROUND OF THE INVENTION

1. Field of the Invention

This invention relates to an ink cartridge for holding ink that is supplied to a recording head, that is removably attached to recording heads used in image forming apparatuses, and to an ink volume detection method for the ink cartridge.

2. Description of the Related Art

Conventionally, image forming apparatuses such as ink jet printers eject ink droplets from nozzles in a recording head mounted on a carriage, thereby recording images on recording media. The ejection of the ink droplets is accomplished by driving actuators such as electric-to-mechanical converter elements or electric-to-thermal converter elements positioned inside the recording head to generate pressure waves. The ink is supplied from an ink cartridge mounted on the recording head so that it can be easily removed and replaced. When air bubbles are mixed in with the ink liquid that is supplied from the ink cartridge, however, this has an adverse effect on the ejection of ink from the nozzles in the recording head.

In FIG. 20 is diagrammed an example of an ink cartridge structure as disclosed in Japanese Patent Application Laid-Open No. H9-70982/1997. An ink cartridge 150 has an ink supply hole 153 for supplying ink to a recording head 137, and an atmosphere connection hole 155 communicating to the outside atmosphere so as to allow air to flow in from outside the cartridge 150 as the ink volume is diminished by the consumption of ink absorbed in a porous material 152. Accordingly, after the ink cartridge 150 is filled with ink during fabrication, both of these openings (i.e. the ink supply hole 153 and atmosphere connection hole 155) are closed off by a sealing material. Also, as disclosed in Japanese Patent Application Laid-Open No. H7-132611/1995 (gazette), for example, at the time of shipment from the factory, the ink cartridge containing ink is sealed in a reduced-pressure condition inside a packaging bag to prevent ink leakage and the intrusion of air into the case prior to cartridge use. When it is time for use, the user removes the ink cartridge from the packaging bag, peels away the sealing material, thereby opening the atmosphere connection hole, and connects the ink supply hole to the recording head.

It is desirable to have the ink supply hole and the atmosphere connection hole located some distance apart in order both to prevent air from being drawn from the atmosphere connection hole into the ink supply hole via a short circuit and to facilitate use of the ink contained in the case without waste. For this reason, the ink supply hole and atmosphere connection hole are located on mutually opposing sides of the case, as diagrammed in FIG. 20. When filling the ink cartridge 150 with ink during the manufacturing process, on the other hand, the ink supply hole 153 serves also as the ink filling hole, and the atmosphere connection hole 155 is used as a pressure-reduction hole in order to reduce the pressure inside the case. Thus ink is filled in through the ink supply hole while effecting reduced pressure inside the case.

In the process of filling the ink cartridge 150 with ink, it is necessary to bring an ink filling apparatus and a pressure reduction apparatus up against both sides (the right side and left side in FIG. 20) of the ink cartridge 150. After the ink filling operation, sealing tape has been used to seal the ink supply hole 153 and the atmosphere connection hole 155. However, in the case of a cartridge structure such as that diagrammed in FIG. 20, the sealing tape must be pulled all the way around the case, from the upper surface (right side surface in FIG. 20) to the lower surface (left side surface in FIG. 20). Not only does this require a long length of tape, but, when the sealing tape is applied using a roller mechanism, the operation cannot be accomplished from one side of the case, so the sealing tape must be pulled around the case from the upper surface to the lower surface while rotating the case, thus involving an inefficient operation.

After sealing the ink filling hole (ink supply hole) with the sealing tape, the sealing tape has been heat welded by the application of heat. If the ink filling hole is wet with ink, however, heat welding cannot be adequately performed. When more heat is applied to avoid this, a problem arises in that the ink supply hole is deformed so that it cannot be properly connected to the recording head.

During the ink filling operation, moreover, when the interior of the case is placed under reduced pressure by the pressure reduction apparatus, the entire case is sometimes deformed, whereupon the case cannot be efficiently filled with ink.

When the configuration is such that a porous material 152 is accommodated inside the cartridge case to absorb the ink, as diagrammed in FIG. 20, it is demanded that the filling be done efficiently so that the ink reaches to the corners inside the porous material 152.

It is also demanded that, when the ink cartridge is being replaced, the user can easily peel away the sealing tape and efficiently utilize the ink in the case.

With this type of ink cartridge, furthermore, the remaining ink volume is continually or periodically detected by a detector installed in the recording apparatus. When it is detected that the remaining ink volume is low, the recording apparatus advises the user to replace the ink cartridge. This detection of the remaining ink quantity inside the ink cartridge is generally performed by detecting the ink liquid level. However, because the liquid level tends to shake and fluctuate because the ink cartridge is mounted on a carriage that moves in a sweeping motion in the width direction of the recording medium, erroneous detections often to occur. That being so, one measure known in the prior art for reducing the liquid level fluctuations (shaking) is that of providing rib-shaped members inside the cartridge case. This measure, however, requires the case structure to be complex. Also known is the method of directing light onto the porous material absorbing the ink inside the case and detecting the remaining ink quantity from the light reflected back. With this method, however, it is difficult to detect the remaining ink quantity accurately because the presence or absence of ink in the porous material differs from location to location therein.

In an ink jet type of image forming apparatus, in order to restore the ink ejection function, a suction cap connected to a suction pump is used to cover the recording head and suck out large amounts of ink from the recording head. When the ink liquid level inside the ink cartridge falls rapidly due to this suction, not all of the ink in contact with the wall surfaces of the ink cartridge moves instantly to the same height position, more or less, as the ink liquid level. Some of this ink remains adhering to the wall surfaces. This phenomenon becomes increasingly pronounced as the distance from the corners of the outer walls of the ink cartridge (i.e. the ridges thereof) increases, that is, the closer the center of the flat wall surfaces is approached. Accordingly, in cased where the detection site for a sensor is located near the center of the cartridge wall surface, even when the ink liquid level falls, so that there is little actual remaining ink quantity, that fact cannot be detected, wherefore erroneous detections occur, which is a problem.

When the remaining ink quantity inside the ink cartridge is being detected with a sensor, particularly one that is of the reflected light type, in order to accurately eject light onto a detection site from a light emitting element, and have the light reflected at the inner surface of the outer wall of the ink cartridge, that is the detection site received without failure by a light receiving element, the positions of the light emitting element and light receiving element relative to the detection site must be accurately established. However, the ink cartridge is made so that it can be freely attached to and detached from the recording head so that the user can replace it. The condition in which the ink cartridge is mounted will be slightly different, therefore, every time the user replaces it. In some cases, moreover, variation in the positions in which the reflected light sensors are attached relative to the carriage will arise at the stage of recording apparatus manufacture. Thus, when there are slight irregularities in the distance between the reflected light sensor and the detection site, or in the attachment position or angle of the reflected light sensor relative to the detection site, the light receiving element cannot properly detect the reflected light, so that the remaining ink quantity inside the ink cartridge cannot be detected or the remaining ink quantity detection precision sharply declines.

With this type of ink cartridge, furthermore, ink sometimes travels along the inner walls of the ink chamber holding the ink and reaches the atmosphere connection chamber adjacent to the ink chamber. This ink sometimes also passes through the atmosphere connection hole and leaks to the outside. If the case is transparent or semi-transparent, the case will become unsightly once ink penetrates into the atmosphere connection chamber. If the ink plugs up the atmosphere connection hole, that will impair the supply of ink to the recording head.

A type of ink cartridge is also known wherein, inside the ink cartridge case, a first chamber is provided for accommodating the porous material absorbing ink, and a second chamber is provided downstream from the first chamber, such that ink is supplied to the recording head via an ink supply hole from the second chamber. With such a structure as this, when air bubbles intrude into the second chamber from the first chamber, and those air bubbles are drawn to the recording head from the second chamber, there is a danger that the recording head will become incapable of ink ejection due to the air bubbles.

In a vacuum pack such as is described in the foregoing, furthermore, in order to maintain the interior thereof at reduced pressure for extended periods of time, it is necessary that there be space between the ink cartridge and the packaging bag of the pack, which space has a higher degree of vacuum than the interior of the ink cartridge. Supposing that a substantially rectangular ink cartridge is contained in a packaging bag, and that the packaging bag adheres tightly to the cartridge, outside air that gradually penetrates through the packaging bag will relatively quickly fill the slight gap between the packaging bag and the ink cartridge, making it difficult to maintain the reduced pressure condition for any extended period of time. Japanese Patent Application Laid-Open No. H10-250111/1998 discloses a cartridge wherein, in order to secure a prescribed volume for the reduced pressure space, the exterior shape is not made a simple rectangle but rather is made so that a part thereof projects, thus forming a space alongside the projecting part where the packaging bag does not tightly adhere. With this cartridge, holes are sometimes opened in the packaging bag by the cartridge corners. In Japanese Patent Application Laid-Open No. 7-132611, art is disclosed for inserting other components (spacers) inside the packaging bag such as corrugated cardboard or urethane foam which contain air internally and through which air readily passes. When separate components are inserted inside the packaging bag, however, the number of manufacturing processes increases, costs rise, and the exterior shape of the packaging bag becomes large, which is undesirable in the interest of smaller size.

SUMMARY OF THE INVENTION

The present invention has been devised for the purpose of resolving the problems with the prior art described in the foregoing. A first object thereof is to provide an ink cartridge wherewith bringing a filling apparatus and a pressure reduction apparatus close to the cartridge package for ink filling is rendered easy, and the operation of applying seals to the case openings is made simple.

A second object of the present invention is to provide an ink cartridge wherewith the case can be efficiently filled with ink all the way to the corners thereof, wherewith case deformation due to reduced pressure during filling is prevented, and wherewith filling can be done even more efficiently.

A third object of the present invention is to provide an ink cartridge that is made so that the remaining ink quantity can be detected utilizing the space that is for filling the case with ink, which suppresses ink liquid level fluctuation even though the case has a simple structure, and wherewith the remaining ink quantity can be detected accurately.

A fourth object of the present invention is to provide an ink cartridge wherewith, even when the liquid level fluctuates rapidly due to ink being drawn out from the recording head, and even when there is variation in the position where the sensor is attached in the recording apparatus, accurate remaining ink quantity detection is made possible.

A fifth object of the present invention is to provide an ink cartridge wherein the intrusion of ink to the atmosphere connection hole side from the ink chamber is prevented, and wherein, even when there is a slight occurrence of such ink intrusion, leakage to the outside and blocking of the atmosphere connection hole is prevented.

A sixth object of the present invention is to provide an ink cartridge wherewith, when ink is being supplied successively from a first chamber to a second chamber in an ink chamber, air bubbles are not drawn directly into the recording head even when air bubbles intrude into the second chamber, and wherewith ink ejection problems caused by air bubbles are prevented.

A seventh object of the present invention is to provide an ink cartridge wherewith the inside of the packaging bag used to hermetically seal the ink cartridge is maintained at reduced pressure for an extended period of time, wherewith there is no particular need for any separate component for forming space for that purpose, and wherewith manufacturing costs can be reduced and achieving smaller size is rendered easy.

An eighth object of the present invention is to provide a remaining ink quantity detection method wherewith the remaining ink quantity inside the ink cartridge can be accurately detected.

According to a first aspect of the present invention, an ink cartridge is provided which is removably attached to a recording head and which holds ink supplied to the recording head, comprising: a case having a first surface and a second surface in mutual opposition, the first surface whereof is open, a first cover for covering the first surface, a partitioning wall for separating the interior of the case into a first chamber and a second chamber, respectively, for holding the ink, a porous material accommodated in the first chamber, an ink filling hole formed in the first cover for filling the first chamber and the second chamber with ink, and a pressure reduction hole formed in the first cover and connected to a reduced pressure source for reducing the pressure in the first chamber and the second chamber, wherein the first chamber and the second chamber are connected near the second surface inside the case.

As based on this structure, the ink filling hole and the pressure reduction hole are in the first surface of the case, wherefore, when performing ink filling in the manufacturing stage, it is only necessary to bring the filling apparatus and the pressure reduction apparatus close to one side of the case, and, after that, sealing need only be effected from one side of the case, thereby rendering the operation easy. During ink filling, moreover, the ink passes successively to the second chamber and the first chamber, from the ink filling hole toward the pressure reduction hole, wherefore both chambers can be filled with ink efficiently. In addition, with this structure, there is no need to open the upper and lower ends, as in a case to be described further below, and if at least one surface is opened, that is sufficient. Also, as will be described subsequently, ink may be supplied to the recording head from the first chamber through the second chamber, or, alternatively, ink may be supplied to the recording head from the second chamber through the first chamber.

In the ink cartridge of the present invention, an ink supply port for supplying ink in either the first chamber or the second chamber may be formed in the second surface of the case. When configured in this way, the ink supply hole is provided in a different surface from the ink filling hole and the pressure reduction hole, wherefore the ink supply hole can be closed off with sealing material prior to ink filling. For this reason, the application of a seal to the ink supply hole is not interfered with by ink adhering to the supply hole as in conventional cartridges. As a result, the ink supply hole can be securely sealed prior to cartridge shipment, and ink can be prevented from leaking out when a user mounts the cartridge onto the recording head.

In the ink cartridge of the present invention, the second surface may also be opened, a second cover provided for covering the second surface, and the ink supply hole formed in the second cover. When configured in this way, both end surfaces of the case are open, wherefore it is easy to form the first chamber and the second chamber. Also, while it is necessary to wash the case so that the ink properties are not changed, washing and drying are easy because both end surfaces are open. Because porous material is inserted into the first chamber and covered by a cover member, moreover, assembly is simple. Furthermore, the operation of applying the sealing material for sealing the ink filling hole and the pressure reduction hole in one surface and the sealing material for sealing the ink supply hole in the other surface can be easily done with a roller or the like while the ink cartridge is being conveyed along during manufacture.

In the ink cartridge of the present invention, an atmosphere connection hole for communicating with the first chamber may be formed in the second cover. When configured in this way, both the ink supply hole and the atmosphere connection hole are provided on the same surface, wherefore the ink supply hole and the atmosphere connection hole can be simultaneously sealed with sealing material during manufacture.

According to a second aspect of the present invention, an ink cartridge is provided which is removably attached to a recording head and which holds ink supplied to the recording head, comprising: a case having a first surface and a second surface in mutual opposition and containing ink therein, wherein, an ink filling hole for filling the case with ink and a pressure reduction hole connected to a reduced pressure source for reducing the pressure inside the case are formed in the first surface, an ink supply hole for supplying ink to the recording head is formed in the second surface, the ink filling hole and the pressure reduction hole are closed off by a first sealing material applied to the first surface, and the ink supply hole is closed off by a second sealing material applied to the second surface so that it can be peeled away.

As based on this structure, the operation of applying the first sealing material for sealing the ink filling hole and the pressure reduction hole in one surface and of applying the second sealing material for sealing the ink supply hole in the other surface can be easily done with a roller or the like while the ink cartridge is being conveyed along during manufacture. The ink supply hole is not used during ink filling, wherefore ink does not leak from the ink supply hole so as to impair the sealability thereof as conventionally. Also, when the cartridge is being mounted on the recording head by a user, it is easy to peel away only the second sealing material in preparation therefor.

In an ink cartridge based on the second aspect of the present invention, an atmosphere connection hole is formed which communicates between the inside and the outside of the case. This atmosphere connection hole may be closed off by the second sealing material which can be peeled away. As a consequence of being configured in this way, when a user loads the cartridge onto the recording head of an ink jet printer or the like, both the ink supply hole and the atmosphere connection hole can be opened simultaneously by peeling away only the second sealing material.

According to a third aspect of the present invention, an ink cartridge is provided which is removably attached to a recording head and which holds ink supplied to the recording head, comprising: a case having a first surface and a second surface in mutual opposition, the second surface is open, a partitioning wall for separating the interior of the case into an ink chamber for holding ink and an atmosphere connection chamber, wherein the ink chamber and the atmosphere connection chamber are open on the second surface side, one end of the atmosphere connection chamber communicates to the ink chamber on the first surface side, and the other end of the atmosphere connection chamber communicates to the outside of the case, and a cover for covering the second surface, wherein is formed an ink supply hole for supplying ink to the recording head, connected to the ink chamber.

With an ink cartridge implemented according to the third aspect of the present invention, ink is supplied to the recording head from the ink chamber via the ink supply hole formed on the second surface side, while air is inducted into the ink chamber on the first surface side via an atmosphere connection path. Consequently, air is not readily admitted to the ink chamber, and the ink in the ink chamber can be used efficiently. Also, this cartridge has a simple structure, and can be easily assembled by covering the second surface with the cover. The ink chamber may also contain a first chamber and a second chamber, as in the specific example of the present invention, but it may also be configured with a single chamber only.

With an ink cartridge implemented according to the third aspect of the present invention, the cover may cover the open surfaces of the ink chamber and the atmosphere connection path, and have a second connecting hole communicating to the atmosphere connection path.

According to a fourth aspect of the present invention, an ink cartridge is provided which is removably attached to a recording head and which holds ink supplied to the recording head, comprising: a case having a first surface and a second surface in opposition, both surfaces whereof are open, a partitioning wall for separating the interior of the case into an ink chamber for holding ink and an atmosphere connection path communicating to the outside of the case, wherein the ink chamber is open on the first surface and the second surface sides, a first cover for covering the first surface of the case so that a path is formed for communicating between the ink chamber and the atmosphere connection path, a second cover for covering the second surface of the case, and an ink supply hole that connects to the recording head, formed in the second cover so as to communicate with the ink chamber.

With an ink cartridge implemented according to the fourth aspect of the present invention, the opposing first and second surfaces of the case are open, respectively, wherefore it is easy to form the ink chamber and the atmosphere connection path inside the case. It is necessary to wash the inside of the case beforehand so that the ink characteristics do not change. Both surfaces are open in this cartridge, making washing and drying convenient. Also, assembly is rendered simple by covering the first and second surfaces, respectively, with the first cover and the second cover. The cartridge may have a second partitioning wall for dividing the ink chamber into a first chamber for accommodating the porous material absorbing ink and a second chamber for accommodating ink. One of the chambers, i.e. the first chamber or the second chamber, may be covered by the first cover while the other chamber is covered by the second cover. In that case, in this type of ink cartridge, the first chamber may communicate with the atmosphere connection path near the first surface and also communicate with the second chamber near the second surface, while the second chamber communicates with the ink supply hole. Based on this aspect, during a recording operation, ink is supplied to the recording head under a suitable pressure from the ink supply hole via the second chamber by the suction force of the porous material in the first chamber. When ink in the second chamber flows out from the ink supply hole, ink is replenished in the second chamber from the porous material in the first chamber while air is taken into the first chamber from the atmosphere connection path. As a result, after the first chamber ink is consumed, the second chamber ink is consumed, whereupon all the ink is used effectively.

According to a fifth aspect of the present invention, an ink cartridge is provided which is removably attached to a recording head and which holds ink supplied to the recording head, comprising: a cartridge case having a mutually opposed first side wall and second side wall, a first partitioning wall positioned substantially parallel to the first side wall of the case so as to separate the interior of the cartridge case into a first chamber and a second chamber, respectively, for accommodating ink, and a second partitioning wall positioned substantially parallel to the first side wall of the case for separating the interior of the case into a first chamber and an atmosphere connection path for communicating with the atmosphere outside the case, wherein one end of the second chamber communicates with one end of the first chamber, the other end of the second chamber is open the outside of the case as an ink supply hole, one end of the atmosphere connection path communicates with the other end of the first chamber, and the other end of the atmosphere connection path is open to the outside of the case.

With an ink cartridge implemented according to the fifth aspect of the present invention, a second partitioning panel (or a first partitioning panel) is placed substantially parallel to a first side wall, wherefore the side wall becomes a two-ply structure so that the strength of the cartridge is increased. For this reason, when the cartridge is being filled with ink, the cartridge is prevented from deforming, even when the interior thereof is under reduced pressure, and ink filling can be accomplished efficiently.

In a cartridge based on the fifth aspect, the atmosphere connection path may be demarcated between the first side wall and the second partitioning wall, and the second chamber demarcated between the second side wall and the first partitioning wall. Also, an ink supply hole for supplying ink to the recording head may be provided near the one end of the second chamber and the ink in the first chamber supplied to the recording head from the ink supply hole via the second chamber. Given this structure, the cartridge is arranged so that the ink supply hole is normally positioned below, wherefore, even should air bubbles flow into the second chamber from the first chamber together with the ink, air bubbles are prevented from floating up toward the top of the second chamber and being drawn into the ink supply hole. For this reason, ink discharge failure from the recording head can be prevented. In a cartridge based on the fifth aspect, the other end of the first chamber may be open, the open part covered by the first cover, the one end of the second chamber open, the open portion covered by the second cover, and the ink supply hole formed in the second cover. With this cartridge, a case can be used which is open on both sides and easily formed, and a cartridge can be easily manufactured by adding a first and a second cover to this case.

In a cartridge based on the fifth aspect, furthermore, a third partitioning wall may be provided which extends substantially perpendicular to the first side wall inside the case and connects the lower ends of the first partitioning wall and the second partitioning wall, the first chamber divided by the first, second, and third partitioning walls, and a connecting hole formed in the third partitioning wall to connect between the first and second chambers. In this case, one end of the first chamber may be open, the open portion covered by the first cover, the ink filling hole connecting the second chamber and the outside of the case formed in the first cover, one end of the second chamber open, the open portion covered by the second cover, and an atmosphere connection hole communicating with the atmosphere connection path formed in the second cover.

According to a sixth aspect of the present invention, an ink cartridge is provided which is removably attached to a recording head and which holds ink supplied to the recording head, comprising: a cartridge case having an upper case surface and a lower case surface, a partitioning wall for dividing the inside of the case into first and second chambers for accommodating ink, respectively, wherein the first and second chambers mutually communicate near the lower case surface, an ink filling hole for filling the second chamber with ink, formed in the upper case surface, a sealing material for closing off the ink filling hole, an ink supply hole for supplying ink to the recording head from the second chamber, formed in the lower case surface, and an atmosphere connection hole for connecting the first chamber to the atmosphere, wherein the second chamber is formed between one side wall of the case and the partitioning wall, and at least one portion of the one side wall is either transparent or semi-transparent.

In a cartridge based on the sixth aspect, when the ink is supplied to the recording head from the ink supply hole of the ink cartridge, ink is supplied from the first chamber to the second chamber, whereupon the first chamber ink decreases in volume first. When the first chamber ink is depleted, air flows into the second chamber and the second chamber ink decreases in volume. Hence the remaining ink quantity can be known by detecting a fall in the ink liquid level in the second chamber, either visually or with a sensor. Also, ink is filled from the second chamber via the ink filling hole, and the filling hole is closed off with a sealing material after the second chamber and the first chamber have been filled, wherefore the second chamber can be completely filled. Thus erroneous detections of the initial remaining ink quantity can be prevented.

In a cartridge based on the sixth aspect, the first chamber may be given a larger capacity than the second chamber and made to accommodate the porous material absorbing ink. Even when a large volume of ink is present in the first chamber, due to the suction force of the porous material, ink can be supplied to the recording head from the ink supply hole under suitable pressure. Also, by detecting the remaining ink quantity in the second chamber of smaller capacity, erroneous detections caused by ink wave formation can be prevented. In this case, the upper case surface may be configured with a cover attached to the case, and the ink filling hole formed in the cover. When this is done, the structure of the ink cartridge becomes simple. If a sheet material is used as the sealing material, this can be easily applied to the cover so as to close off the ink filling hole.

In a cartridge based on the sixth aspect, the inner surface of the transparent or semi-transparent portion of the one side wall may have undulating ribs running vertically up and down.

Based on this configuration, when, for example, a remaining ink quantity sensor is used that comprises a light emitting component and a light receiving component, the light emitted by the light emitting component is reflected at the inner surface of the side wall of the second chamber, whereupon it is scattered by the undulating ribs on that inner surface in directions perpendicular to the undulating ribs, and the reflected light advances toward the light receiving component while spreading out in a plane that includes the light emitting component, the light receiving component, and the detection site on the main case body. Therefore, even in cases where the interval between the detection site and the sensor has slightly changed due to slight differences in the ink cartridge mounting position or sensor attachment position, the light receiving component can safely capture the reflected light. Accordingly, the remaining ink quantity inside the ink cartridge can be unambiguously detected even when there is some degree of variation in the sensor attachment condition or ink cartridge mounting condition.

According to a seventh aspect of the present invention, an ink cartridge is provided which is removably attached to a recording head and wherein the remaining ink quantity inside the cartridge is detected by an optical detector having a light emitting component and a light receiving component, comprising: a cartridge case having in its interior an ink chamber for holding ink, and a remaining ink quantity detection site provided on the case, wherein the inner case surface at the detection site has undulating ribs extending in a direction perpendicular to a plane containing the detection-light light emitting component, the light receiving component, and the detection site, and the remaining ink quantity inside the ink chamber is detected by illuminating light to the detection site and receiving the light that is reflected therefrom.

Based on this configuration, the inner surface of the ink chamber that constitutes the site for detecting by the reflected light sensor has undulating ribs extending in a direction perpendicular to a plane that contains the light emitting component and light receiving component of the emitted light sensor and the detection site in the ink chamber, wherefore when light emitted by the light emitting component is reflected at the inner surface of the ink chamber side wall, it is scattered by the undulating ribs on that inner surface in directions perpendicular to the undulating ribs, and advances toward the light receiving component while spreading out in a plane that includes the reflected-light light emitting component and light receiving component and the detection site. Therefore, even in cases where the interval between the detection site and the reflected-light sensor has slightly changed due to slight differences in the ink cartridge mounting position or in the reflected-light sensor attachment position, the light receiving component can safely capture the reflected light. Accordingly, the remaining ink quantity inside the ink chamber can be unambiguously detected even when there is some degree of variation in the reflected-light sensor attachment condition or ink cartridge mounting condition.

The cartridge case having undulating ribs can be formed using a die. In the ink cartridge based on the seventh aspect, the outer case surface at the detection position may have undulating ribs extending parallel to a plane containing the light emitting component, the light receiving component, and the detection site. Based on this configuration, light reflected at the outer surface of the outer wall of the main case body is scattered by the undulating ribs on that outer surface in directions perpendicular to those undulating ribs, and the reflected light advances to the light receiving component while spreading out outside of the plane containing the light emitting component and the light receiving component of the reflected-light sensor and the detection site on the main case body, wherefore it is difficult for the light receiving component to capture light reflected at the outer surface of the outer wall which does not contribute to remaining ink quantity detection. Accordingly, of the reflected light captured by the light receiving component, the ratio of that component of the light reflected from the inner surface of the outer wall contributing to remaining ink quantity detection rises, whereupon the precision wherewith the remaining ink quantity is detected is improved.

According to an eighth aspect of the present invention, an ink cartridge is provided which is removably attached to a recording head and which holds ink supplied to the recording head, comprising: a cartridge case having an upper case surface and a lower case surface, a partitioning wall for separating the interior of the cartridge case into a first chamber for holding ink and an atmosphere connection chamber for communicating with the atmosphere outside the case, one end of the wall is joined to the upper case surface, and a path for connecting the first chamber and the atmosphere connection chamber, formed in the upper case surface, wherein the path and the first chamber are connected via a portion of a surface which does not contain an intersection line formed by the intersection of a surface and a surface.

Based on the ink cartridge according to the eighth aspect of the present invention, the first chamber holding the ink is not connected by an intersection line (or ridge line) formed by the intersection of a surface and a surface, such as the intersection line formed by the upper case surface and the partitioning wall. With the cartridge of the present invention, the first chamber and the path are connected via a curved surface such as the inner surface of the pressure reduction hole diagrammed in FIG. 12, wherefore the ink in the first chamber is prevented from traveling along the intersection line formed by the upper case surface and the partitioning wall and advancing into the path. The upper case surface, moreover, need not be integral to the case, but may be a cover member that can be placed over the opening in the empty main case body during manufacture. When this is done, the path can be formed in the cover member, making fabrication of the case itself simple.

In the ink cartridge based on the eighth aspect of the present invention, porous material absorbing ink may be accommodated in the first chamber. The cartridge case may also be configured such that a projecting part that projects inside the first chamber is formed on the upper case surface, at a position apart from the partitioning wall, such that the projecting part pushes against the porous material inside the first chamber. This projecting part corresponds to the wall 27 in FIG. 12. The wall 27 juts out toward the ink chamber, and the inner wall thereof does not contain an intersection line formed by the intersection of a surface and a surface. By making the upper ink surface a cover member, as described in the foregoing, an upper case surface can be easily formed which has a projecting part.

In the ink cartridge based on the eighth aspect of the present invention, the path is formed by a concavity extending from the first chamber on the outer side surface of the upper case surface to the atmosphere connection chamber, a first hole connecting the concavity and the first chamber, a second hole connecting the concavity and the atmosphere connection chamber, and sealing material covering the concavity. With this structure, the path can be fabricated easily with few parts.

According to a ninth aspect of the present invention, an ink cartridge is provided which is removably attached to a recording head and which holds ink supplied to the recording head, comprising: a cartridge case having an upper surface and a lower surface, and a partitioning wall for dividing the interior of the case into an ink chamber for holding ink and an atmosphere connection path for communicating to the ink chamber and also communicating to the atmosphere outside the case, wherein the atmosphere connection path extends from the lower surface of the case to the upper surface thereof, a part of the inner wall of the lower surface of the case projects into the atmosphere connection path inside the case, and a connecting hole is passed through the projecting part for communicating between the outside of the case and the atmosphere connection path, whereby ink can be accumulated in the atmosphere connection path inside the case.

With the ink cartridge based on the ninth aspect of the present invention, even if ink leaks from the ink cartridge chamber and flows into the atmosphere connection path, a connecting hole is formed in the projecting part that projects from the lower surface of the cartridge case toward the interior of the case (cf. 18*a* in FIG. 4), wherefore the ink will not immediately block the connecting hole. In other words, the ink is accumulated above the lower surface inside the case, and so, until it exceeds the height of the projecting part, will not pass through the connecting hole and leak to the outside of the case.

According to a tenth aspect of the present invention, an ink cartridge is provided which is removably attached to a recording head and which holds ink supplied to the recording head, comprising: a cartridge case having an upper case surface and a lower case surface; a partitioning wall for dividing the inside of the cartridge case into a first chamber for accommodating a porous material absorbing ink and a second chamber for holding ink, wherein the partitioning wall has a first part that is in opposition to the lower surface of the case, whereby a portion of the second chamber exists between the partitioning wall and the lower case surface, and a connecting hole for connecting the first chamber and the second chamber is formed in the first part of the partitioning wall; an ink supply hole, formed in the lower case surface, for supplying ink from the second chamber to the recording head; and a baffle plate, provided between the connecting hole and the ink supply hole, for preventing air bubbles from flowing into the ink supply hole from the connecting hole.

With the ink cartridge based on the tenth aspect of the present invention, when ink is ejected from the recording head with the ink cartridge mounted on the recording head, ink is drawn by the negative pressure developed in the recording head from the second chamber through the ink supply hole and, at the same time, ink from the first chamber is drawn into the second chamber through the connecting hole. Air bubbles produced at this time are prevented from flowing into the ink supply hole by the baffle plate. For this reason, ink ejection problems associated with the inflow of air bubbles to the recording head are prevented from occurring. Due to the baffle plate, the air bubbles rise up toward the upper case surface inside the second chamber.

In the ink cartridge based on the tenth aspect, the lower case surface is a cover member installed in the case at the time of ink cartridge fabrication. The ink supply hole is formed in this cover member, and the baffle plate is formed in either the cover member or the partitioning wall, or in both. If the lower case surface is made a cover member that can be assembled in the main case body at the time of ink cartridge fabrication, instead of being made integral with the main case body, assembly is made easy, and, even if the baffle plate forms a complex flow path, it may be easily provided in either the cover member or the partitioning wall.

In the ink cartridge based on the tenth aspect, the partitioning wall may have a second part that extends from the end of the first part toward the upper case surface, and the second chamber made so that it is divided between a first and second partitioning wall and a case interior wall. If a second chamber is configured in this way, air bubbles will be guided by the baffle plate and rise inside the second chamber along the second part of the partitioning wall and accumulate at the top of the second chamber.

In the ink cartridge based on the tenth aspect, the first part of the partitioning wall from the connecting hole to the second part should be inclined toward the upper case surface. If the first part of the partitioning wall is inclined in this way, air bubbles originating from the connecting hole will readily float along the first part of the partitioning wall up to the upper part of the second chamber, whereupon the influx of air bubbles into the ink supply hole is prevented even more effectively.

According to an eleventh aspect of the present invention, an ink cartridge is provided which is removably attached to a recording head and which holds ink supplied to the recording head, comprising: a cartridge case, and a partitioning wall for dividing the inside of the cartridge case into an ink chamber for holding ink and an empty chamber that communicates to the outside of the case, wherein the ink chamber and the empty chamber do not mutually communicate.

Based on the ink cartridge of the eleventh aspect of the present invention, there is an empty chamber (space) inside the cartridge case, wherefore, when the cartridge is sealed in a bag and the pressure inside the bag is reduced, that reduced-pressure condition can be maintained for an extended period of time. That is, when the bag is rendered in a reduced-pressure state, although air will gradually find its way into the bag with the passage of time, due to the presence of the empty chamber, the reduced-pressure state can be maintained for a comparatively long period of time. With the present invention, this empty chamber can be secured without the necessity of any other parts, wherefore fabrication is simple, and manufacturing costs can be reduced.

In the ink cartridge of the eleventh aspect of the present invention, the cartridge case may be configured from a main case body one end whereof is open, and a cover member for covering the open part of the main case body, the empty chamber formed by the cover member and the partitioning wall, and a hole provided in the cover member for connecting the empty chamber to the outside of the case. By configuring the case in this manner, the empty chamber can be easily formed inside the case.

In the ink cartridge of the eleventh aspect of the present invention, a bag may be used which hermetically seals the ink cartridge and the ink cartridge may be accommodated in a bag under reduced pressure. By maintaining the ink cartridge inside the bag in this manner, the ink can be maintained for extended periods of time with the air evacuated.

In the ink cartridge of the eleventh aspect of the present invention, the ink chamber may have a first chamber for accommodating porous material absorbing ink, and a second chamber that holds ink and communicates with the first chamber via a connecting hole, the second chamber whereof is covered by the cover member, an ink supply hole for supplying ink to the recording head from the second chamber formed in the cover member, and the empty chamber formed adjacent to the second chamber.

In the ink cartridge of the eleventh aspect of the present invention, the ink supply hole for transferring ink from the ink chamber to the recording head may be formed in the cover member, the ink supply hole and the atmosphere connection hole closed off with a sealing material that can be peeled away, and the cartridge case sealed in a bag under reduced pressure. By sealing the cartridge in the bag under reduced pressure after closing off the ink supply hole and the atmosphere connection hole with the sealing material, the ink inside the cartridge can be maintained for long periods of time with the air evacuated.

According to a twelfth aspect of the present invention, a remaining ink quantity detection method is provided for detecting the remaining quantity of ink in an ink cartridge having a case divided by a plurality of wall surfaces the interior whereof is filled with ink, comprising the steps of: directing detection light onto a ridge part that is formed by the intersection of at least two side surfaces which extend vertically up and down in the case and that extends vertically up and down, and detecting light reflected from the ridge part.

Based on this method, capillary action is induced at the ridge part extending vertically up and down and formed by the intersection of at least two inner surfaces of the ink chamber, whereby ink adhering to the inner surfaces of the ink chamber moves immediately, in conjunction with the fall in the ink liquid level, to a point proximate to that ink liquid level, wherefore there will be no erroneous detections of the presence or absence of ink at the detection site, and the remaining ink quantity in the ink chamber can be detected precisely.

With the remaining ink quantity detection method described above, the remaining ink quantity may be detected using an optical sensor, which optical sensor may be positioned opposite the ridge part. The ridge part may be made of a transparent or semi-transparent material, and the sensor may have a light receiving component and a light emitting component facing the ridge part. The case may comprise a first chamber that communicates with the atmosphere and accommodates a porous material absorbing ink, and a second chamber, the upper part of which is sealed, that communicates with the first chamber and holds ink and the ridge part exists on the second chamber.

With the remaining ink quantity detection method described in the foregoing, the ink cartridge may further comprise a partitioning wall for dividing the interior of the case into a first chamber and a second chamber for holding ink, at least part of the wall surface of the second chamber whereof is transparent or semi-transparent, a connecting hole for mutually communicating between the first chamber and the second chamber, an ink filling hole, formed in the upper end of the second chamber, for filling the first chamber with ink from the second chamber via the connecting hole, a sealing member for closing off the ink filling hole, an ink supply hole, formed in the lower end of the second chamber, for supplying ink to the recording head, and an atmosphere connection hole for connecting the first chamber to the atmosphere. With this cartridge, the remaining ink quantity in the second chamber will begin dropping after the ink in the first chamber has been depleted, wherefore the decline in the remaining ink quantity can be detected unambiguously.

With the remaining ink quantity detection method described in the foregoing, the interior surface of the case at the ridge part may have undulating ribs extending perpendicular to a plane containing the light emitting component and the light receiving component of the optical sensor and the ridge part.

DESCRIPTION OF THE PREFERRED EMBODIMENTS

A specific embodiment of the present invention is now described with reference to the drawings.

Figure 1:
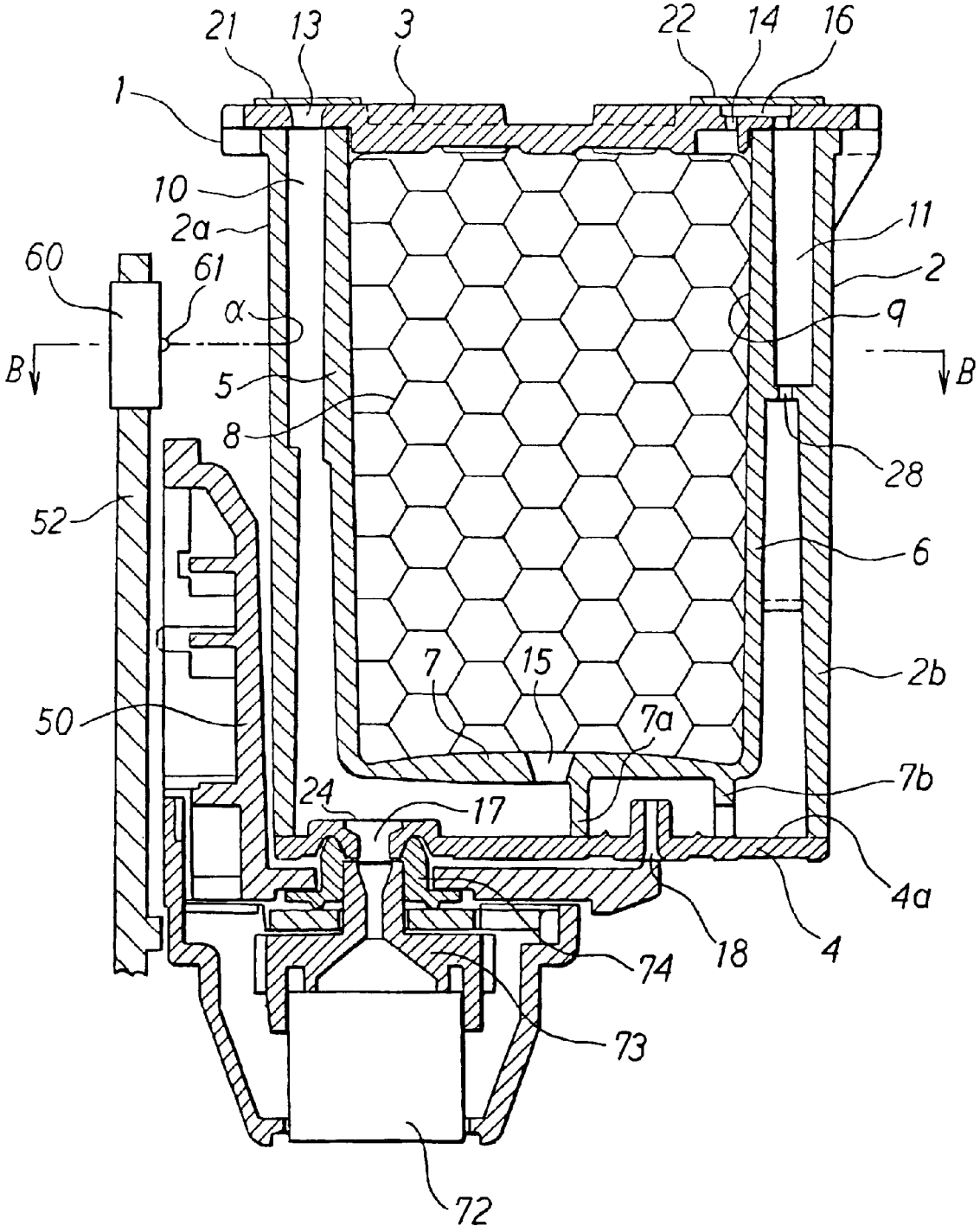
FIG. 1 is a cross-sectional view depicting an ink cartridge according to a first embodiment of the present invention mounted on a recording head.

FIG. 1 is a diagram of the ink cartridge according to this embodiment, showing it connected to a recording head. A head holder 50 for supporting the recording head 72 is mounted on a carriage 52 which moves so as to sweep across a recording medium. In this holder 50 is loaded the ink cartridge 1 so that it can be detached. An ink supply hole 17 made in the bottom surface of the ink cartridge 1 fits into a joint member 74 on the head holder 50 side, and ink is distributed through a manifold member 73 to many ink ejection channels in the recording head 72. The recording head 72 ejects ink from the ink ejection channels by the action of actuators consisting of piezoelectric elements or heating elements.

Figure 2:
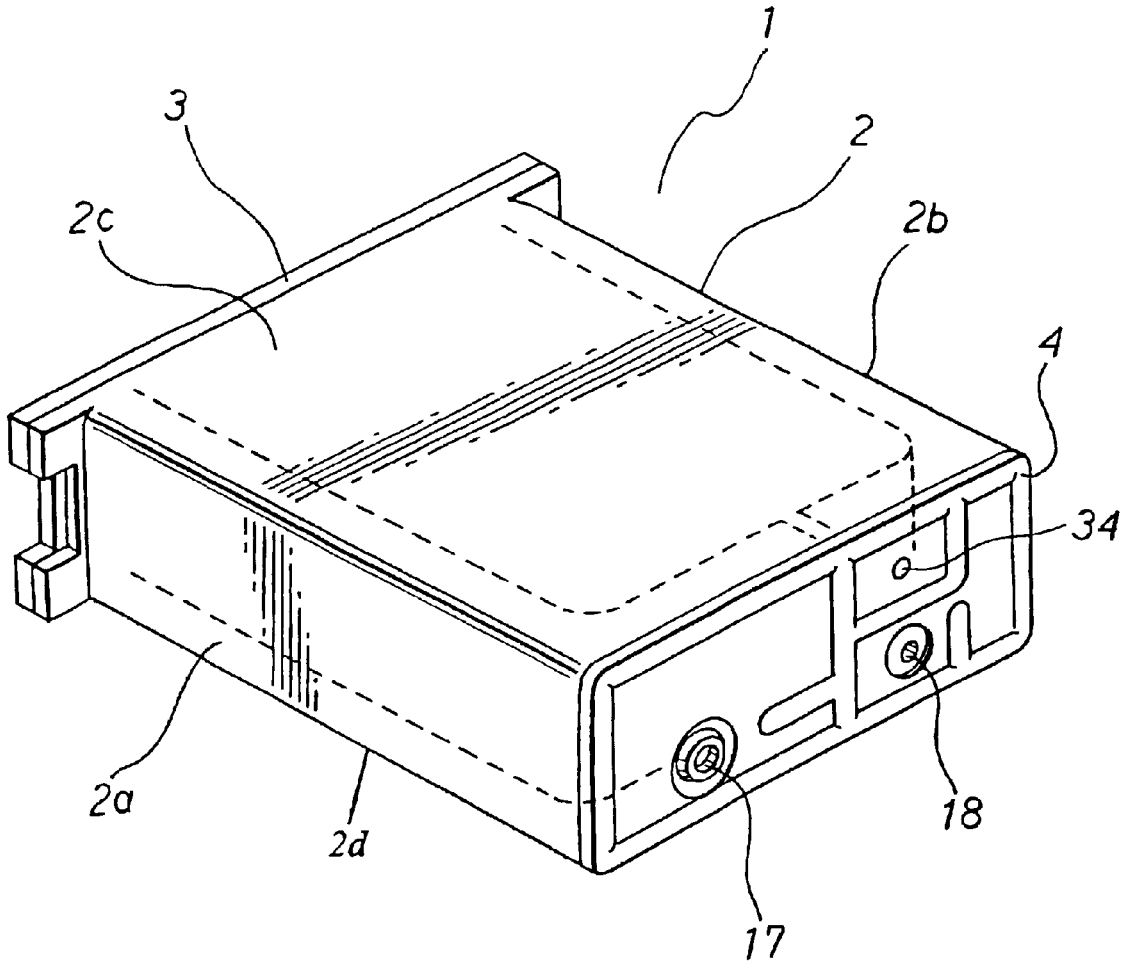
FIG. 2 is an external view of the ink cartridge.
Figure 3:
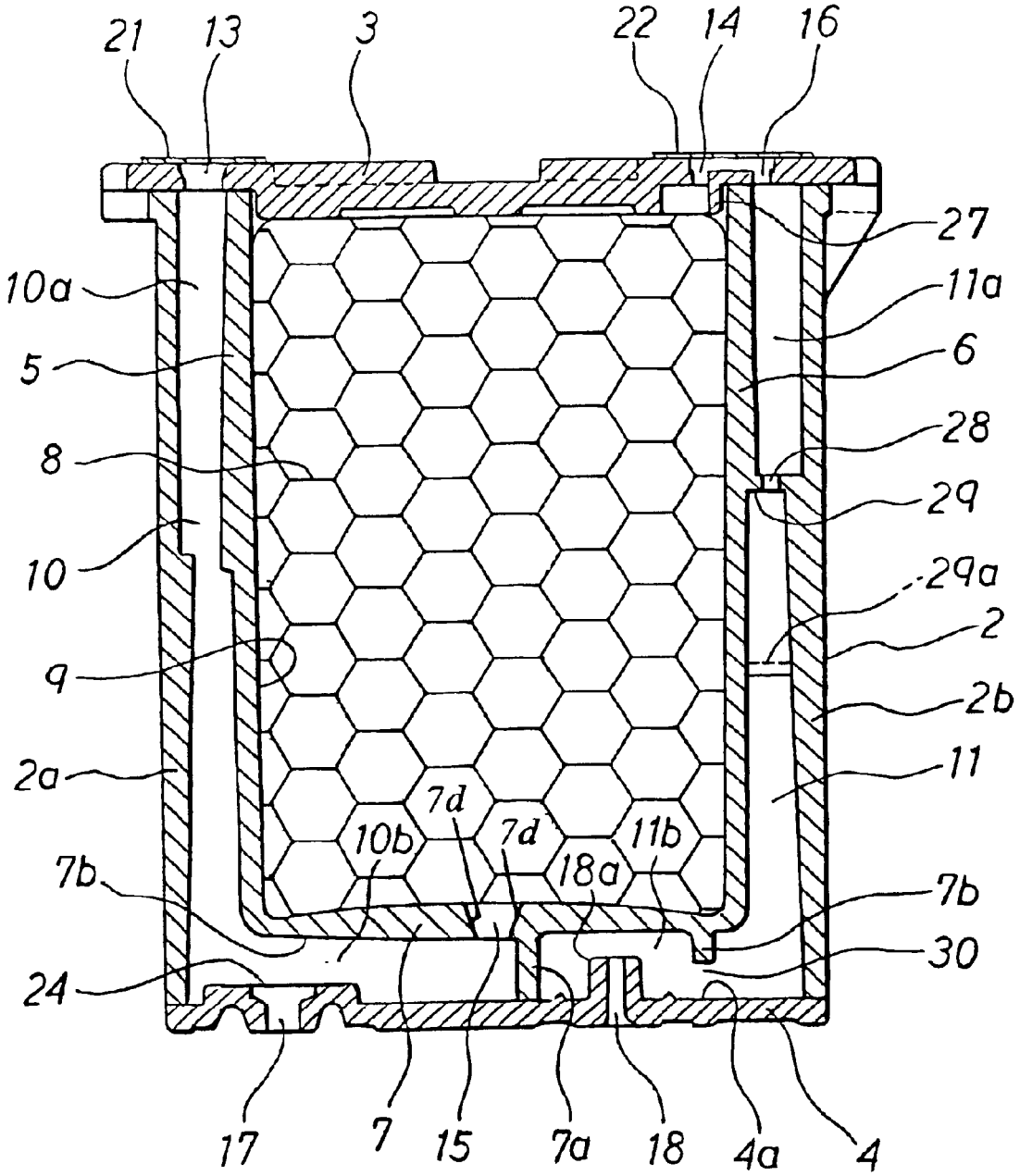
FIG. 3 is a cross-sectional view of the ink cartridge.

The ink cartridge 1 according to this embodiment comprises a case 2 made in a rectangular shape from a transparent or semi-transparent resin material, and upper and lower cover members 3 and 4. The case 2 consists of a pair of opposing first side walls 2*a* and 2*b*, and, connecting between that pair of side walls, a pair of second side walls 2*c* and 2*d* (cf. FIG. 2) so as to form a rectangular tube open at both the upper and lower ends. The upper and lower cover members 3 and 4 are heat welded so as to cover the open upper and lower tube ends. The case 2 is formed so that it is divided in the interior thereof by partitioning walls 5 and 6 that extend substantially parallel to the first side walls 2*a* and 2*b* (the left and right walls in FIG. 3), a bottom partitioning wall 7 that joins the lower ends of those two partitioning walls and extends substantially parallel to the open bottom tube end, and partitioning walls 7*a*, 7*b*, and 7*c* that extend vertically from the bottom partitioning wall 7 toward the bottom open tube end. The partitioning walls 5 and 6, the bottom partitioning wall 7, and the partitioning walls 7*a* and 7*b* extend so as to bridge between the second side walls 2*c* and 2*d* (cf. FIG. 2).

In the space enclosed by the partitioning walls 5 and 6, the bottom partitioning wall 7, and the second side walls 2*c* and 2*d* is formed a first chamber 9, the upper face whereof is open at the upper end of the case 2, which accommodates porous material 8 such as polyurethane foam absorbing ink. In the space enclosed by one of the first side walls 2*a*, the partitioning wall 5, and the second side walls 2*c* and 2*d* is formed a second chamber 10, while in the space enclosed by the other first side wall 2*b*, the partitioning wall 6, and the second side walls 2*c* and 2*d* is formed an atmosphere connection path 11. The second chamber 10 and the atmosphere connection path 11 are each open at their upper ends at the upper surface of the case 2, while the lower ends thereof bend around the lower surface of the bottom partitioning wall and have their lower ends open at the lower surface of the case 2 (cf. FIG. 4).

The upper cover member 3 covers the upper ends, respectively, of the first chamber 9, the second chamber 10, and the atmosphere connection path 11, and is secured by heat welding to the upper ends of the side walls 2*a*, 2*b*, 2*c*, and 2*d* and the partitioning walls 5 and 6, making the chambers 9 and 10 and the path 11 independent. The lower cover member 4 covers the lower ends, respectively, of the second chamber 10 and the atmosphere connection path 11, and is secured by heat welding to the lower ends of the side walls 2*a*, 2*b*, 2*c*, and 2*d* and the partitioning walls 7*a* and 7*b*, making the second chamber 10 and the path 11 independent. As a result, the second chamber 10 and the atmosphere connection path 11 substantially constitute an L shape with a vertical part 10*a* along the side walls 2*a* and 2*b*, and horizontal parts 10*b* and 11*b* positioned below the first chamber 9. The vertical part 11*a* and the horizontal part 11*b* of the atmosphere connection path 11 are connected through a connecting hole 30 provided in the partitioning wall 7*b*.

In the bottom partitioning wall 7 is formed a connecting hole 15 that connects the first chamber 9 and the second chamber 10. Ink is accommodated in both the first chamber 9 and the second chamber 10, and both of these chambers form the ink chamber. The second chamber 10 serves as a path during ink filling, as is described below, and serves as a relay chamber when ink is being supplied from the first chamber 9 to the recording head 72. The first chamber 9 is formed such that it is sufficiently larger than the second chamber 10. The atmosphere connection path 11 admits air to the first chamber 9 when ink in the first chamber 9 is consumed. A separation is made between the second chamber 10 and the atmosphere connection path 11 by the partitioning wall 7*a* at the lower surface of the bottom partitioning wall 7. As described in the foregoing, the partitioning walls 5 and 6 are made substantially parallel with the side walls 2*a* and 2*b* on either side of the case 2, rendering the sides in a more or less double-walled structure and strengthening the case. The case 2 shaped in this way can be easily formed of resin by a die that separates vertically up and down.

In the upper cover member 3 is formed an ink filling hole 13 corresponding with the open face at the upper end of the second chamber 10, and a pressure reduction hole 14 for reducing the pressure inside the case during ink filling, facing the open face at the upper end of the first chamber 9. The connecting hole 15 that mutually connects the second chamber 10 and the first chamber 9 is located at the end that is far from the side on which the ink filling hole 13 and pressure reduction hole 14 are located, that is, on the side opposite thereto, thereby enhancing ink filling efficiency and ink consumption efficiency, as will be described below.

The first chamber 9 and the atmosphere connection path 11 are connected by a path 16 formed so as to cross the upper end of the partitioning wall 6 in the upper cover member 3. More specifically, this path 16 has a concavity formed in the upper surface of the upper cover member 3, one end whereof communicates to the first chamber 9 via the pressure reduction hole 14, and the other end whereof communicates with the atmosphere connection path 11 via a through hole 16*a*. The upper cover member 3 has a wall 27 that is in contact with the upper surface of the porous material 8 projecting into the first chamber 9 (cf. FIG. 4). More specifically, the upper cover member 3 is formed so as to be thicker in the portion thereof corresponding with the first chamber 9, so as to slightly compress the ink absorbing material 8. The wall 27 is separated by an interval from the inner surface of the first chamber 9, as will be described below, and the pressure reduction hole 14 is positioned further to the inside of the first chamber 9 than the outer periphery of the wall 27.

In the lower cover member 4 is formed an ink supply hole 17 for supplying ink from the second chamber 10 to the recording head, corresponding to the open face at the lower end of the second chamber 10, and an atmosphere connection hole 18 corresponding to the open face at the lower end of the atmosphere connection path 11. As diagrammed in FIG. 6, the connecting hole 15 and the ink supply hole 17 are positioned so as to be mutually offset as seen from the bottom. In the second chamber 10, a rib-shaped baffle plate 31 is formed across the shortest path connecting the connecting hole 15 and the ink supply hole 17. This baffle plate 31 is made to project integrally from the partitioning wall 7 of the case 2, and it is preferable that it be formed so as to join the inner wall surface of the lower cover member 4, but there is no reason why it cannot be made to project integrally from the lower cover member 4. The lower surface 7*d* of the bottom partitioning wall 7 (cf. FIG. 3) forms an inclined surface that rises from the lower end of the connecting hole 15 toward the vertical part of the second chamber 10. One end of the baffle plate 31 is positioned at the side of the connecting hole 15, while the other end thereof extends to a point near the vertical part of the second chamber 10. Thus, when ink is drawn from the second chamber 10 by the negative pressure developed by the ejection of ink from the recording head 72, the ink flow coming out of the connecting hole 15 from the first chamber 9 detours around the baffle plate 31, as indicated by the arrow 32, passes through the vertical part 10*a* of the second chamber 10, again enters the horizontal part 10*b* of the second chamber 10, and arrives at the ink supply hole 17.

Figure 4:
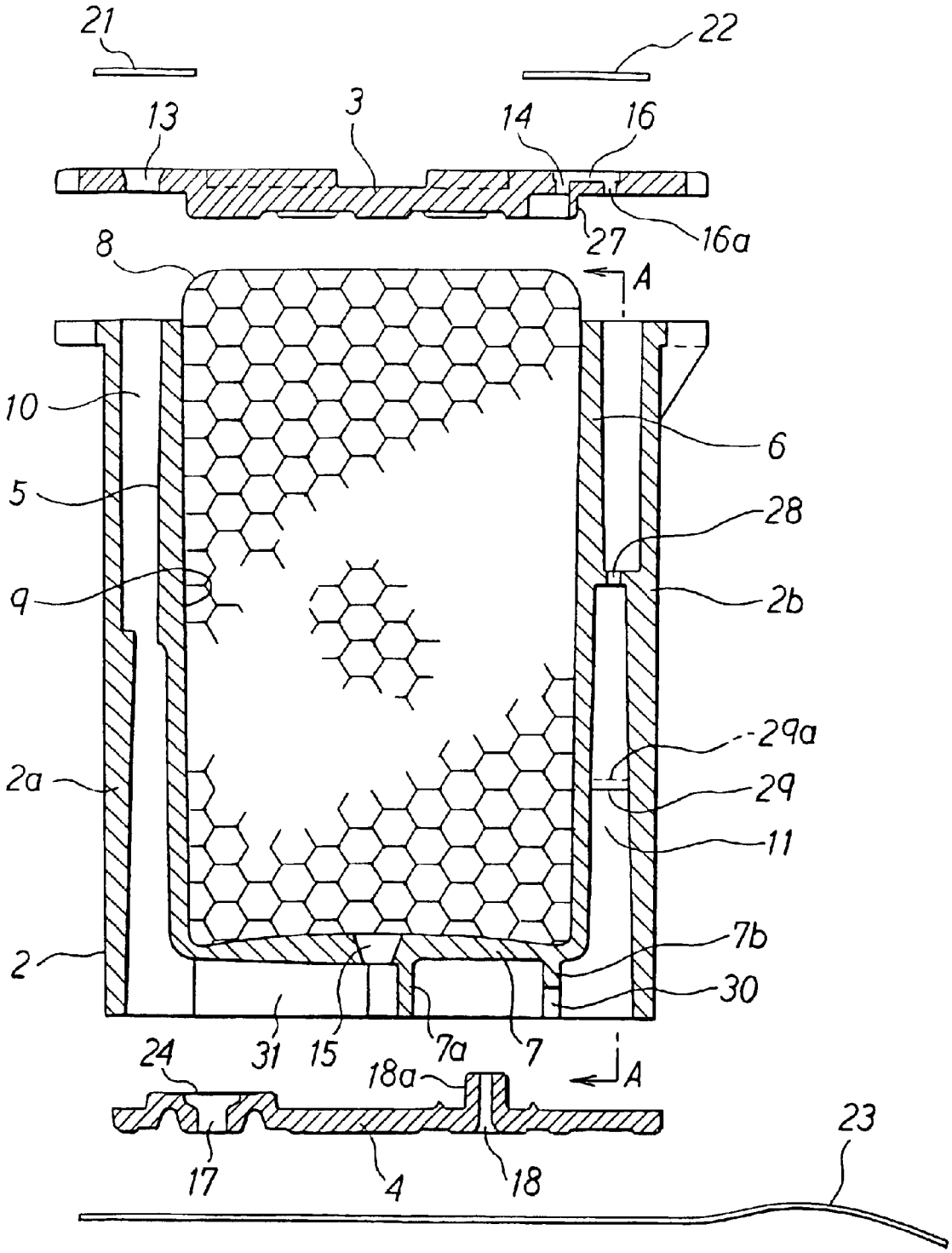
FIG. 4 is an exploded cross-sectional view of the ink cartridge.

As diagrammed in FIG. 4, the ink filling hole 13 and the pressure reduction hole 14, after ink filling, are closed off by first sealing materials 21 and 22 applied to the outer surface of the upper cover member 3 by heat welding or the like. The sealing material 22 covers the upper surface thereof so as to secure the path 16. The ink supply hole 17 and the atmosphere connection hole 18 are closed off by a second sealing material 23 that is applied by heat welding or the like such that it can be peeled away. The ink filling hole 13 and the ink supply hole 17 are separated, wherefore the second sealing material 23 is applied to the ink supply hole 17 prior to ink filling. For this reason, the periphery of the ink supply hole 17 is not wet by ink during filling as with a conventional ink supply hole that doubles as the ink filling hole, wherefore an adequate sealing effect can be obtained even with mild heat welding such as will not deform the ink supply hole. The sealing materials 21 and 22 do not need to be peeled away, wherefore they may be heat welded more strongly even to the point of slightly deforming the upper cover member 3. The sealing materials 21, 22, and 23 are made of a resin, metal foil, or laminated material thereof that is not penetrable by air.

A stainless steel screen filter 24 is attached to the face of the ink supply hole 17 on the second chamber 10 side. The screen holes of this filter 24 are of a size such that the ink inside the second chamber 10 will not naturally leak out due to surface tension.

Figure 10:
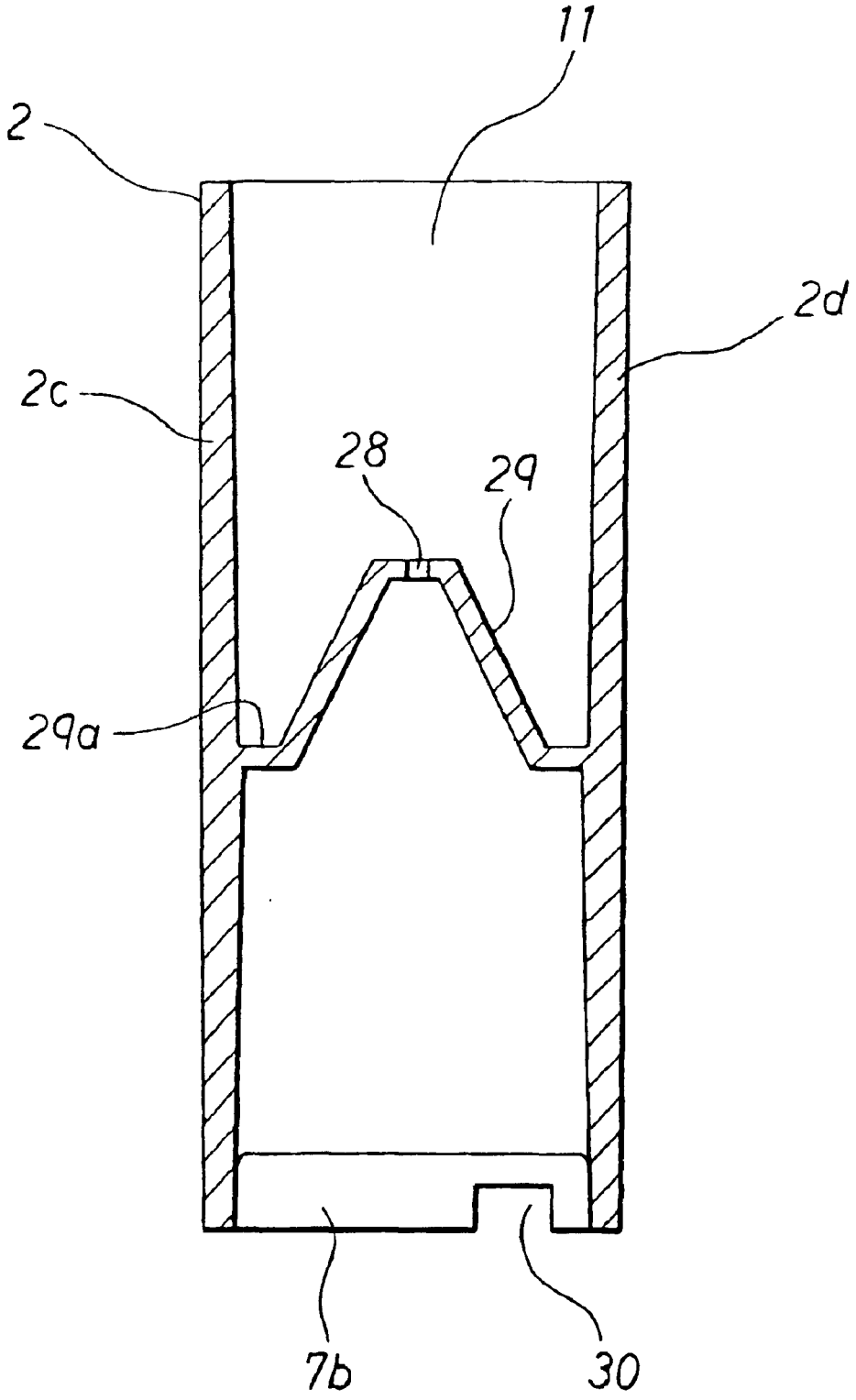
FIG. 10 is a cross-sectional view in the A—A plane.

As diagrammed in FIG. 10, a partitioning wall 29 for partitioning the atmosphere connection path 11 into an upper and lower part is formed midway along the vertical part 11*a* of the atmosphere connection path 11. This partitioning wall 29 extends so that there are differences in height in the vertical direction of the atmosphere connection path 11. A through hole 28 is formed in the high portion thereof, and a concavity is formed so as to provide an ink sump 29*a* positioned lower than the upper end surface of the through hole 28. The partitioning wall 29 can be molded with the separating parts of a die that separates vertically up and down when molding the case 2 out of resin, thus requiring no special process.

By having the peripheral wall 18*a* of the atmosphere connection hole 18 in the lower cover member 4 project upward, moreover, an ink sump 4*a* is formed about the periphery thereof. By this means, ink that leaks out through the path 16 from the first chamber 9 when the ink cartridge falls over, etc., accumulates in the ink sump 29. The ink in the ink sump 29, even if it enters the through hole 28 by the ink cartridge being tilted, etc., will collect in the ink sump 4*a* below. Accordingly, the atmosphere connection path 11 and atmosphere connection hole 18 will not be plugged, nor will ink leak out to the outside.

Figure 6:
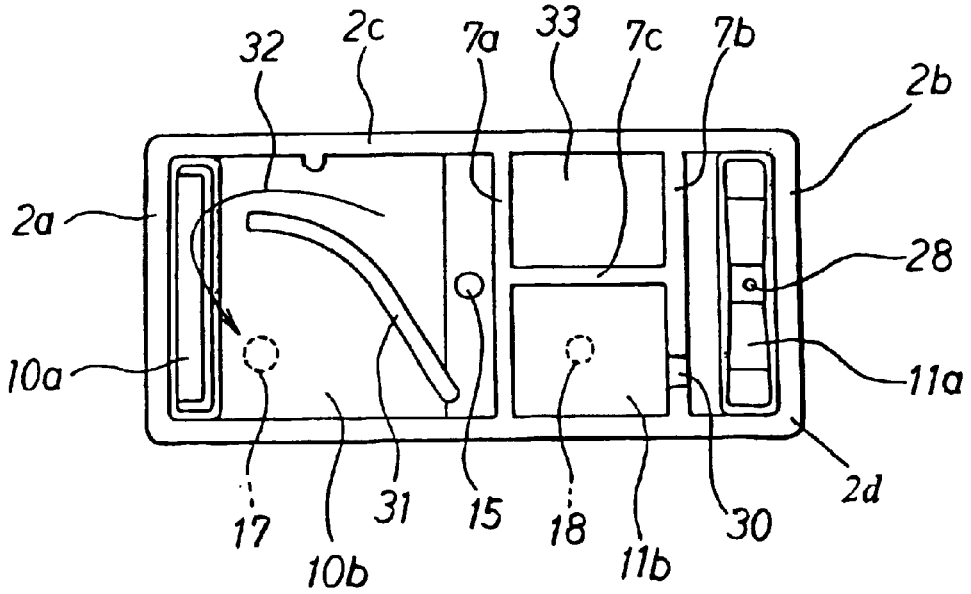
FIG. 6 is a bottom view of a case with the lower cover member of the ink cartridge removed.
Figure 7:
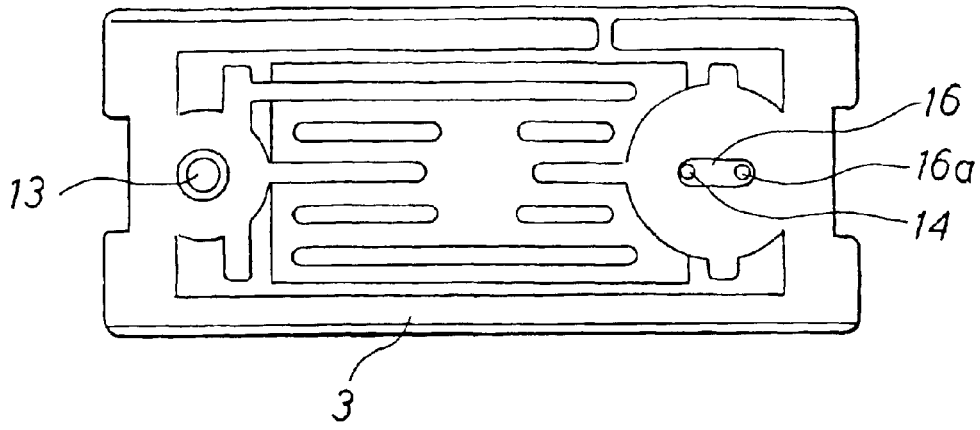
FIG. 7 is a top view of the ink cartridge before applying the upper cover member seal.
Figure 8:
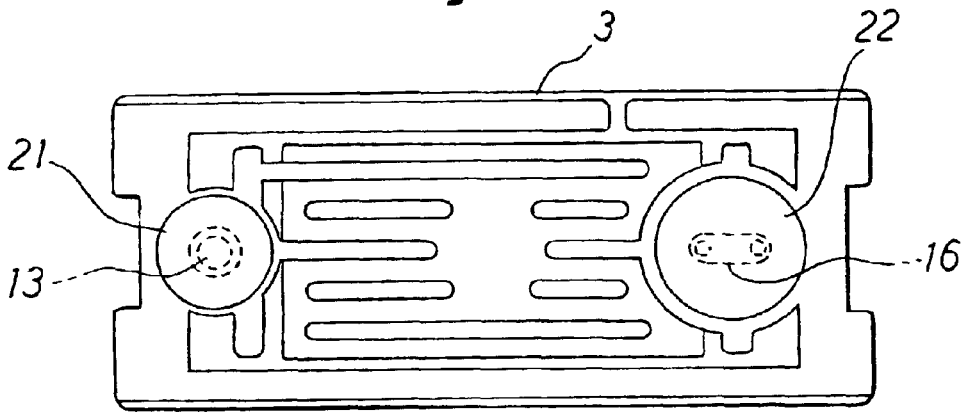
FIG. 8 is a top view of the ink cartridge after applying the upper cover member seal.
Figure 9:
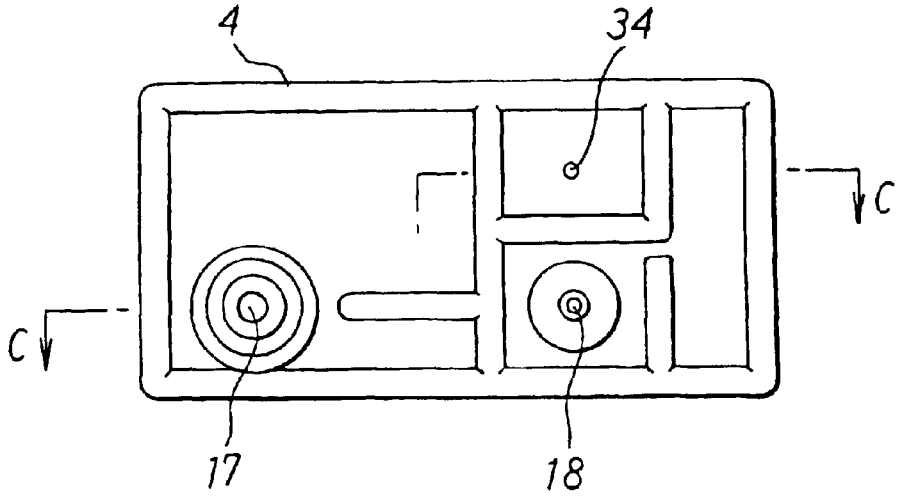
FIG. 9 is a bottom view of the ink cartridge.
Figure 19:
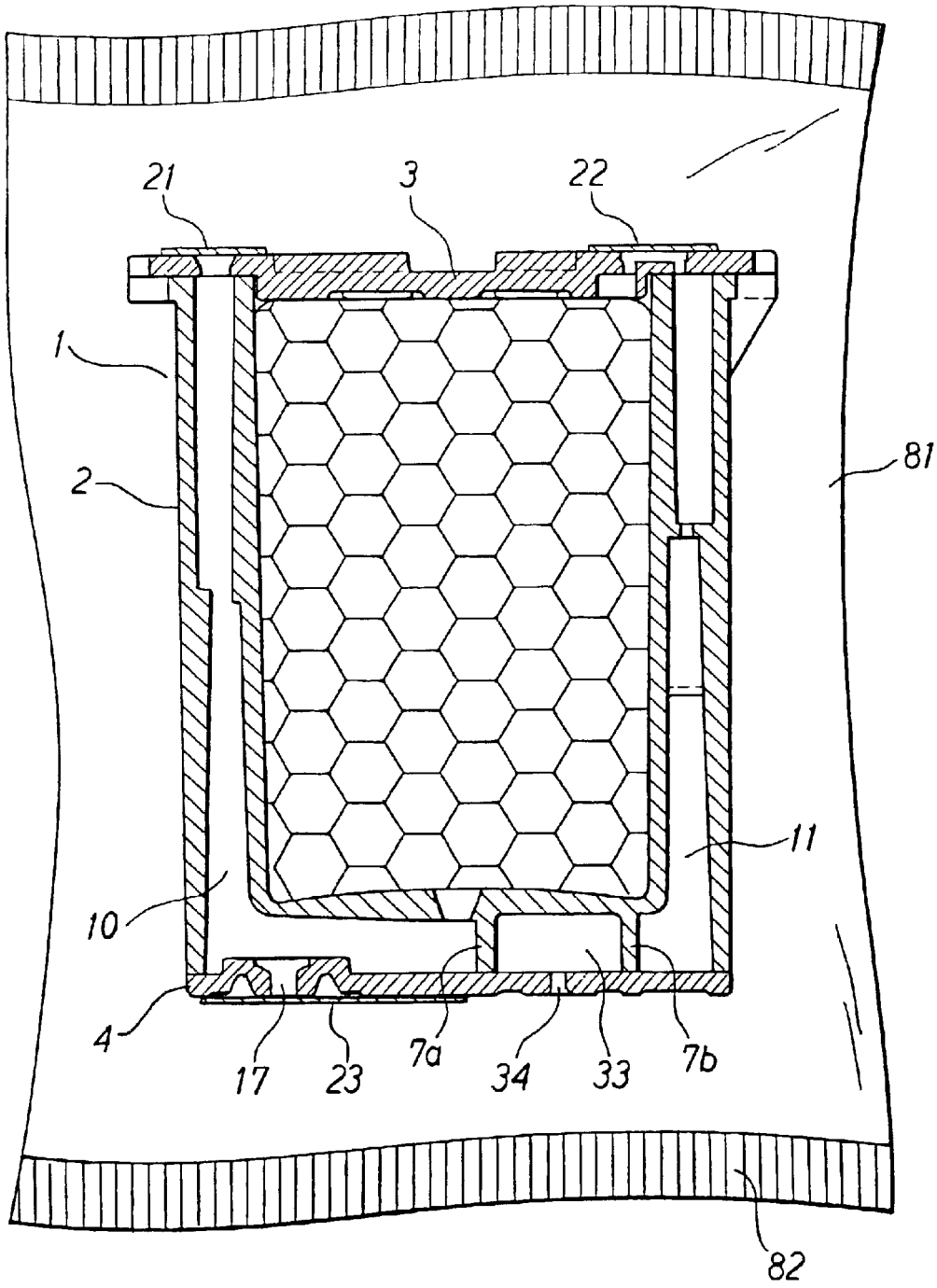
FIG. 19 is a cross-sectional view of the ink cartridge when accommodated in a packaging bag.
Figure 20:
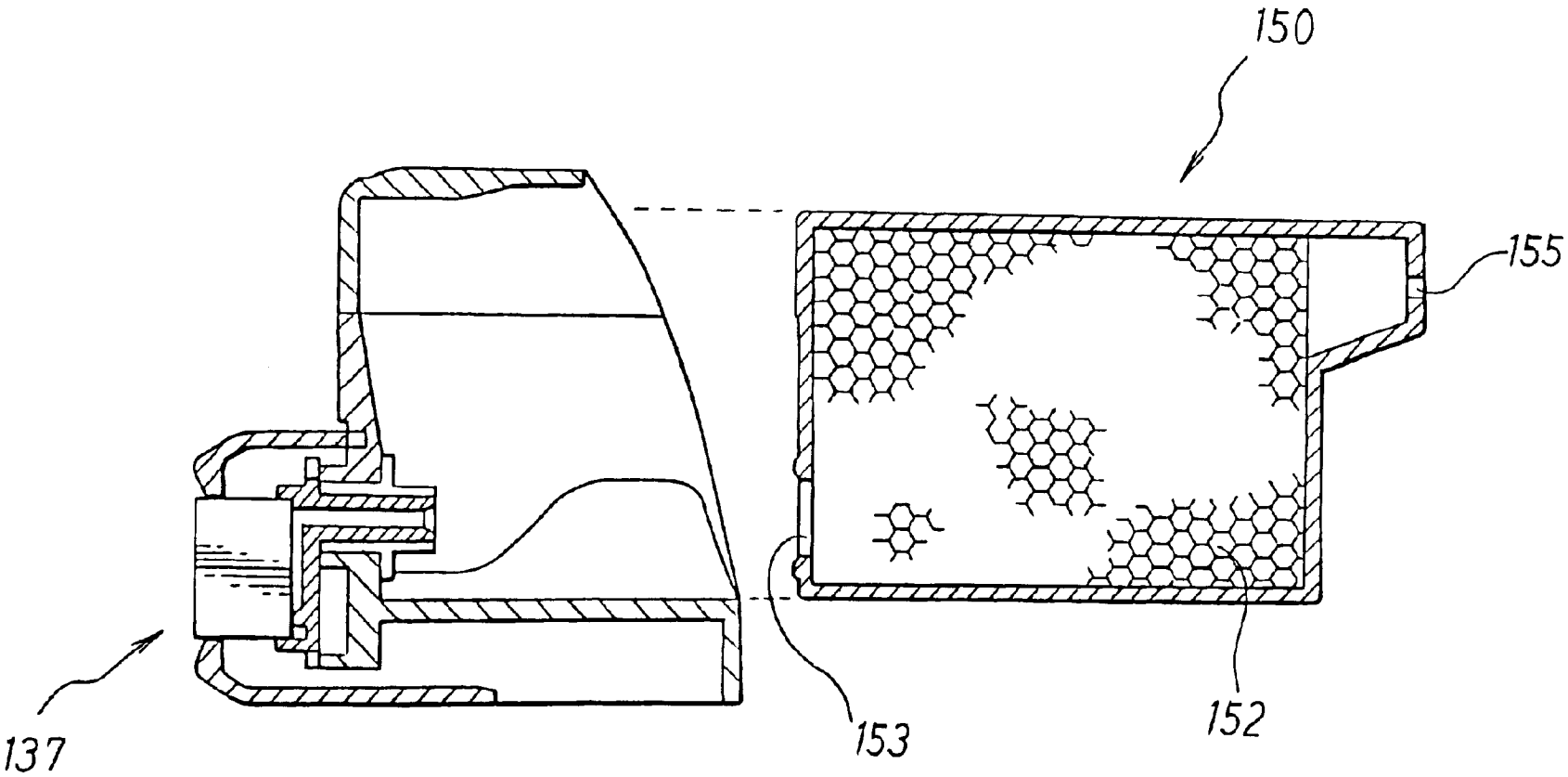
Fig. 20 Related Art
FIG. 20 depicts an example of a conventional ink cartridge structure.

As diagrammed in FIG. 6 and FIG. 19, in the case 2, a space 33 is formed adjacent to the horizontal parts 10*b* and 11*b* of the second chamber 10 and the atmosphere connection path 11. This space 33 is divided by the partitioning wall 7*c* that bridges between the partitioning walls 7*a* and 7*b*, is covered below by the lower cover member 4, and does not communicate with the second chamber 10, the first chamber 9, or the atmosphere connection path 11, but does communicate with the outside of the case through an opening 34 provided in the lower cover member 4. When an ink cartridge 1 that has been filled with ink is shipped, it is accommodated in a reduced pressure condition inside a packaging bag 81, as diagrammed in FIG. 19. The packaging bag 81 accommodates the ink cartridge 1 inside a tubular material, the interior whereof is evacuated with reduced pressure, and both open ends whereof are given fused closures 82. The packaging bag 81 is made of a resin, metal foil, or laminated material thereof that is not penetrable by air. The cross-section of the ink cartridge 1 diagrammed in FIG. 19 corresponds to a cross-section in the C—C plane in FIG. 9. The opening 34 is not covered by the second sealing material 23. When the packaging bag 81 is rendered in a reduced pressure condition, the space 33 is also rendered in a reduced pressure state, and acts, by the capacity thereof, to maintain the interior of the sealed packaging bag 81 in a reduced pressure condition for an extended period of time. Thus is the ink inside the case, prior to use, prevented from being exposed to air.

Figure 11:
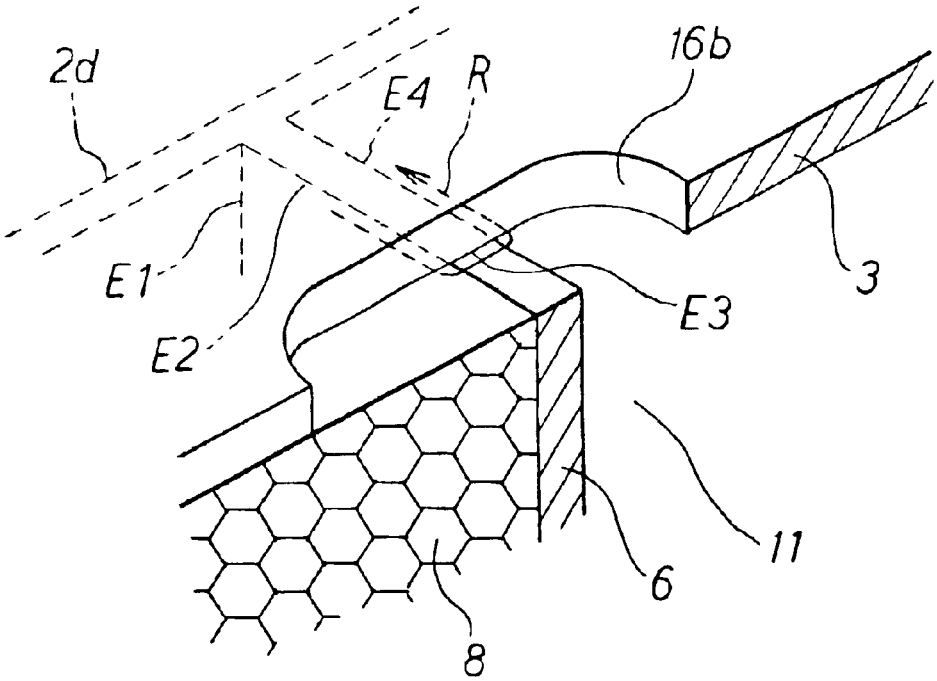
FIG. 11 is an enlarged diagonal view of the configuration of the path 16*b* between the first chamber and the atmosphere connection path.
Figure 12:
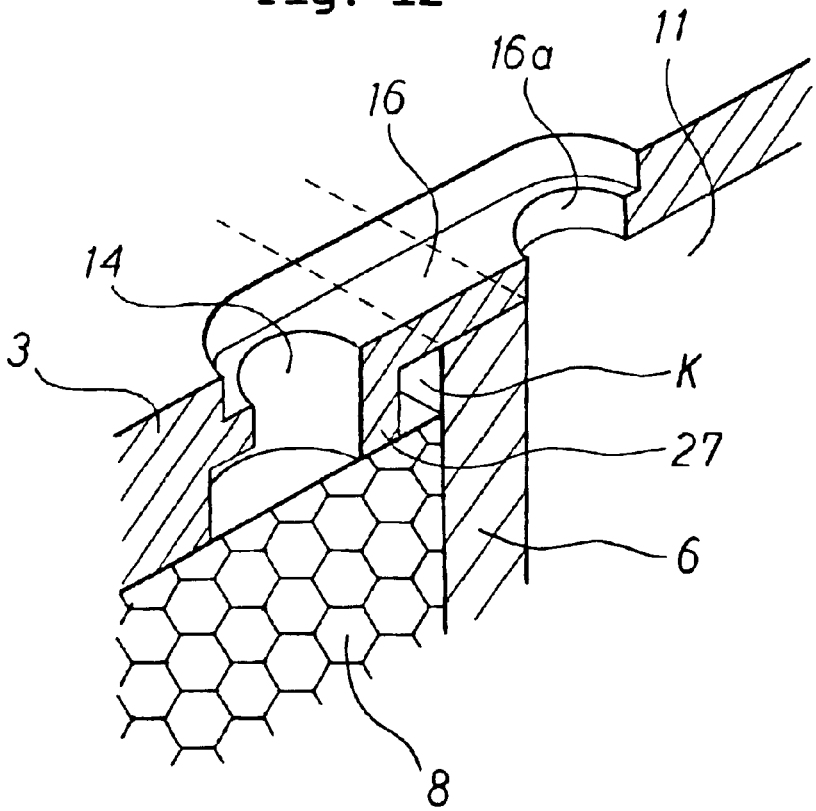
FIG. 12 is an enlarged diagonal view of an improved configuration for the connecting part in FIG. 11.
Figure 13:
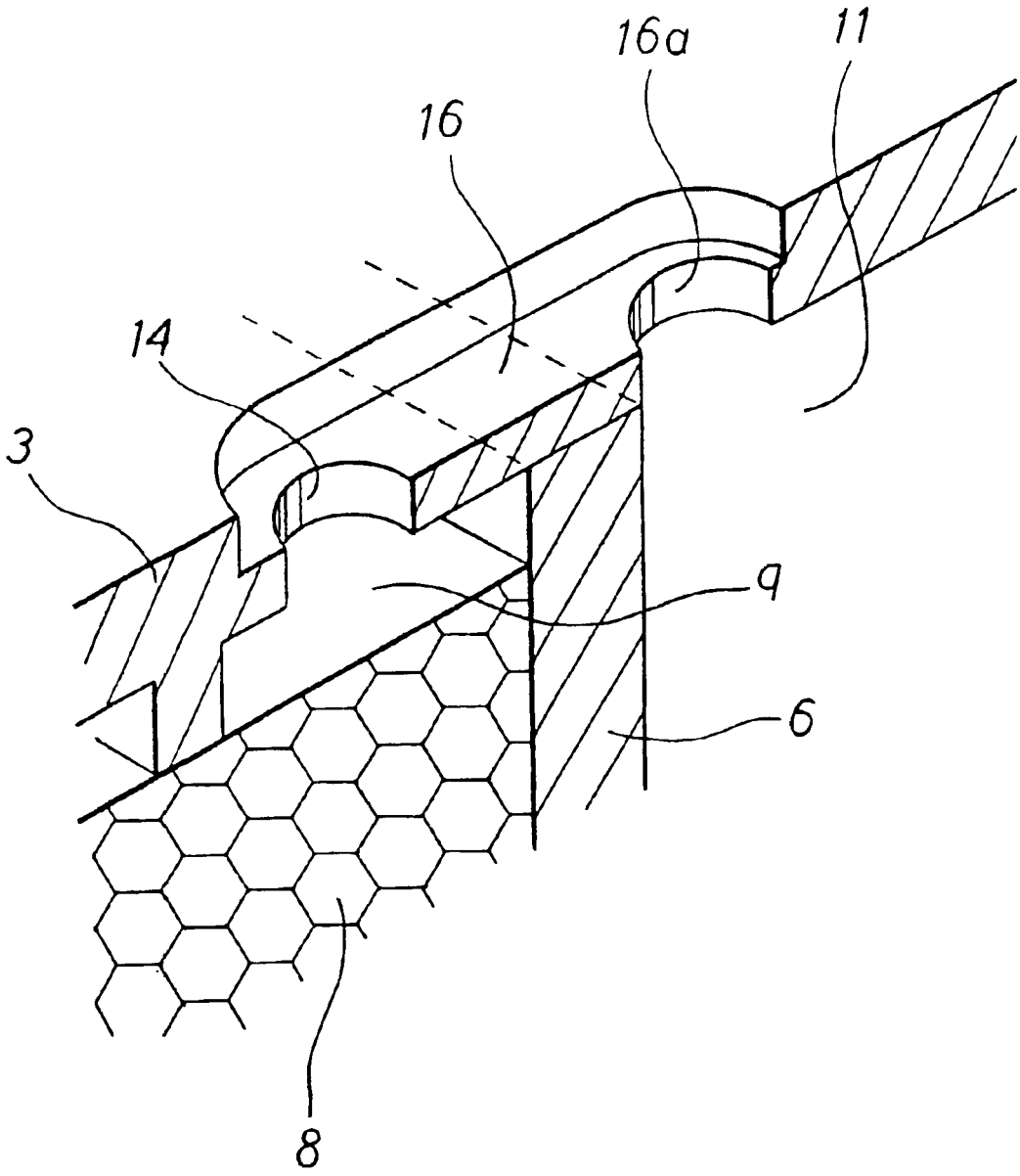
FIG. 13 is an enlarged diagonal view of a further improved configuration for the connecting part in FIG. 11.

FIGS. 11, 12, and 13 show details of the configuration of the path 16 parts. The configuration diagrammed in FIG. 11 is given as a reference for explaining problems. In this figure, the path 16*b* is formed so as to pass through the upper cover member 3*a*, thus mutually communicating between the first chamber 9 and the atmosphere connection path 11. The upper face of the path 16*b* is covered by the sealing material 22 (not shown). In this case, the intersection (ridge line) E1 formed by the partitioning wall 6 and the side walls 2*c* and 2*d*, and the intersection E2 formed by the partitioning wall 6 and the upper cover member 3, readily collect ink through capillary action. Furthermore, because the intersections E1 and E2 are continuous with the intersection E3 formed by the inner surface of the path 16*b* and the partitioning wall 6, ink collected at the intersections E1 and E2 flow to the intersection E3 by capillary action, as indicated by the arrow R, and from there flow out along an intersection E4 inside the atmosphere connection path 11. When ink penetrates from the first chamber 9 toward the atmosphere connection path 11, an unsightly condition develops if the case is transparent or semi-transparent, and ink can also leak out to the exterior of the case or plug the atmosphere connection path 11. When this happens, the ink supply to the recording head 11 from the first chamber 9 is sometimes blocked.

In order to resolve the problem described above, an interval K is opened with the inner surface of the first chamber 9 about the periphery of the wall 27 that projects from the upper cover member 3 toward the first chamber 9, as diagrammed in FIG. 12. The pressure reduction hole 14 is given a circular cylindrical or rounded rectangular shape which does not have intersections on its inner surface, and positioned at the end of the wall 27, removed from the partitioning wall 6. With this configuration, the inside edge or intersection of the partitioning wall 6 on the first chamber 9 side does not connect with the path 16 or atmosphere connection path 11 only by an inside edge or intersection formed by two planes. In other words, the lower surface of the wall 27, the outer circumference of the wall 27, and the inner surface of the pressure reduction hole 14 are formed so that they do not have inside edge or intersections formed by two planes, and the intersection of the partitioning wall 6 on the first chamber 9 side connects with the atmosphere connection path 11 via these surface portions(flat portions). Accordingly, ink that oozes out when the porous material 8 is compressed by the wall 27 and ink collecting at the intersections on the first chamber 9 side are prevented from flowing out by capillary action to the path 16 or the atmosphere connection path 11. There are also no intersections on the inner surface of the pressure reduction hole 14 in contact with the porous material 8, and, in addition, since the pressure reduction hole 14 is positioned in the thick part of the upper cover member 3 and the height of the pressure reduction hole 14 is sufficient, the ink inside the porous material 8 is prevented from flowing along the inside of the pressure reduction hole 14 and penetrating to the path 16. Even supposing that the gap between the partitioning wall 6 and the outer periphery of the wall 27 is small and that ink rises through the gap due to capillary action, ink will not penetrate to the atmosphere connection path 11 because the upper end of the partitioning wall 6 is fused to the cover member 3.

When the pressure reduction hole 14 is shaped so that there is an intersection on the inner surface, the same effect can be realized by giving the inner surface of the path 16 an edgeless (no intersection) cross-section that has the shape of a semicircular cylinder or rounded rectangle.

In FIG. 13 is diagrammed an example of the path 16 portion diagrammed in FIG. 12 the structure of which has been modified. With the structure diagrammed in FIG. 13, the wall 27 has been eliminated, wherefore ink is prevented from rising along that wall to the path 16.

A remaining ink quantity detection sensor 60 is provided in the carriage 52 of the ink jet printer. More specifically, while the ink cartridge 1 is in the unused state, ink is filled into the porous material 8 in the first chamber 9 and in the second chamber 10 so that no space is left remaining. When the ink is consumed by a recording operation, however, and the ink in the first chamber 9 is depleted, due to the pressure wherewith the ink is drawn by the recording head 72, air enters the second chamber 10 from the first chamber 9, a gap portion develops at the top of the second chamber 10, and the ink liquid level falls. The remaining ink quantity detection sensor 60 detects whether or not there is a remaining ink quantity from changes in the light reflected according to whether or not ink is present on the inner wall surface of that second chamber 10.

Figure 5:
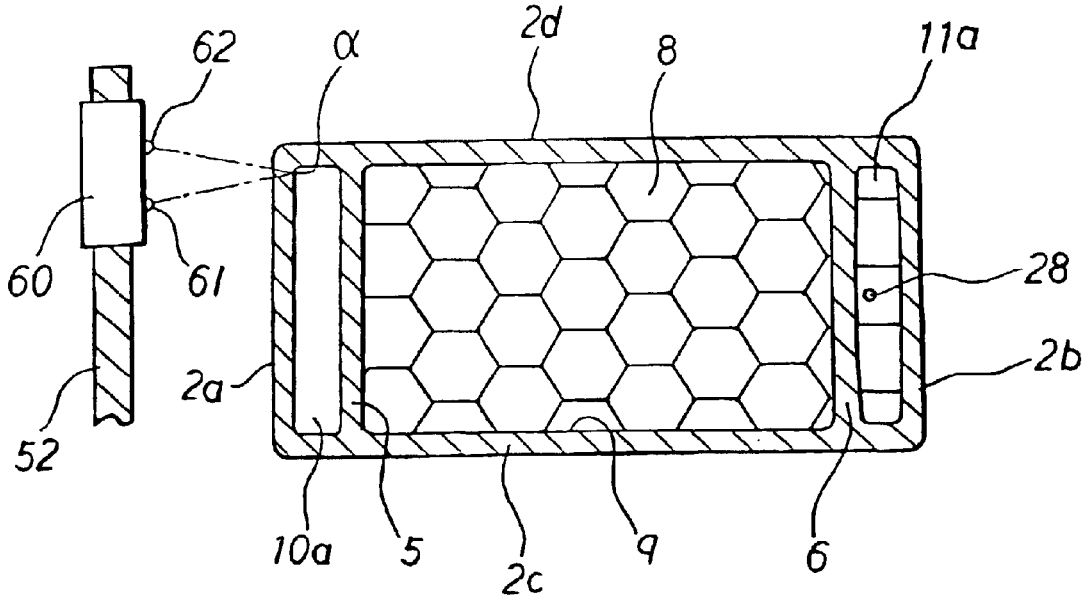
FIG. 5 is a cross-sectional view in the B—B plane of FIG. 1.
Figure 15:
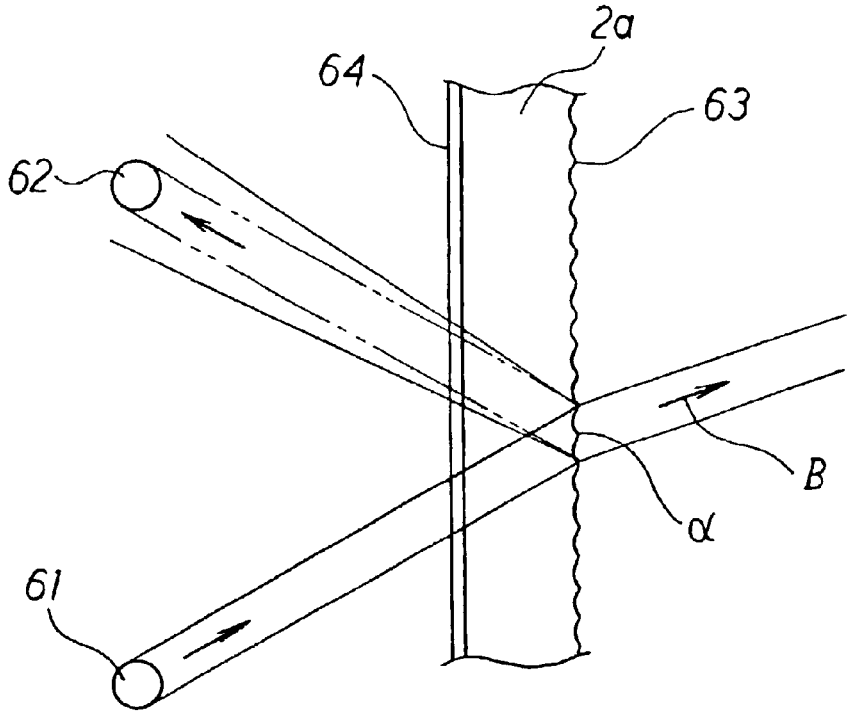
FIG. 15 is a horizontal cross-sectional view that conceptually diagrams the way light is reflected at the remaining ink quantity detection site.

The remaining ink quantity sensor 60 is configured, as shown in FIG. 15, with a light emitting element 61 and a light receiving element 62 provided on either side of a detection site α, with a prescribed interval opened in the horizontal direction of the second chamber 10, so that the light emitting element 61 emits light at the detection site a that is established at a prescribed height position on the side wall 2*a* of the case 2 looking toward the second chamber 10, and so that the light receiving element 62 can capture the light that is reflected from the inner surface of the side wall at that detection site α (cf. FIG. 5). For this purpose, the case 2 need only have that portion at the detection site α made transparent or semi-transparent in order to secure light transmissivity.

Figure 14:
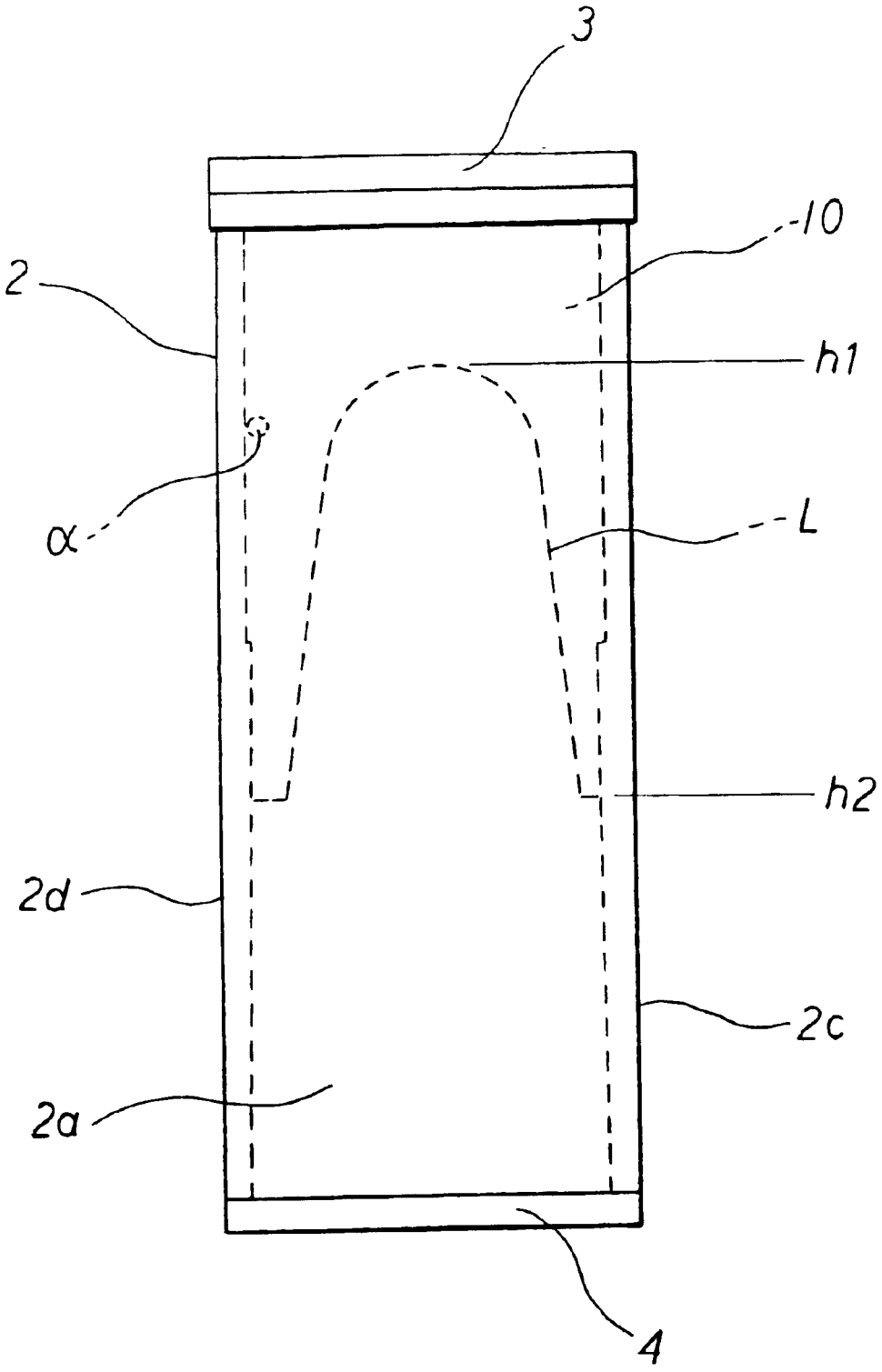
FIG. 14 is a side elevation of the ink cartridge.

The detection site α is established, as diagrammed in FIG. 15, at the place (corner) where the ridge line is formed by the intersection of the inner surface of the side wall 2*a* and the side wall 2*d* adjacent thereto and extends up and down, inside the second chamber 10 of the ink cartridge 1. If the detection site α is established thusly at the ridge line (corner) of the second chamber 10, then, as will be described below, when the height of the ink fluid level inside the second chamber 10 falls precipitously from level h1 to level h2, as diagrammed in FIG. 14, even if the ink L adhering to the inner surface of the side wall 2*a* is held in the vicinity of level h1 in the center of the side wall 2*a*, the ink L that was adhering near the corner on the inner surface of the side wall 2*a* will move immediately to the vicinity of level h2 at the same height as the ink liquid level due to capillary action exhibited by the corner, wherefore the presence or absence of ink inside the second chamber 10 at the detection site α can be detected precisely. Such a precipitous fall in the liquid level will occur when, after ink liquid level h2 has been shaken to h1 by the sweeping movement of the carriage, a suction cap (not shown) is connected to the recording head 72 and ink is drawn out.

It is also possible to provide a rib that protrudes from the inner surface of the side wall 2*a* into the second chamber 10 and extends in the height direction of the second chamber 10, and establish the detection site α at the ridge line formed by that rib and the inner surface of the side wall 2*a*. However, by establishing the detection site α in the corner that exists in an ordinary ink cartridge, as described in the foregoing, the detection precision of the remaining ink quantity sensor 60 can be enhanced without making the structure of the ink cartridge 1 complex.

Also, as discussed in the foregoing, by detecting the remaining ink quantity in the second chamber 10 where the ink liquid level fluctuation finally appears after almost all of the ink in the first chamber 9 has been consumed, the remaining ink quantity at the point in time where the ink cartridge 1 should be replaced can be made extremely small, so that ink waste that occurs when the ink cartridge 1 is replaced can be held to a minimum.

Furthermore, as diagrammed in FIG. 15, many finely undulating ribs 63 are formed on the inner surface of the side wall 2*a* looking into the second chamber 10 where the detection site α is established in a direction perpendicular to the plane containing the light emitting element 61, the light receiving element 62, and the detection site α, that is, in the vertical up and down direction of the ink cartridge 1, while on the outer surface of the side wall 2*a* where the detection site α is established, many finely undulating ribs 64 are formed in a direction parallel to the plane containing the light emitting element 61, the light emitting element 62, and the detection site α, that is, in the fore-and-aft direction of the ink cartridge 1.

Figure 16:
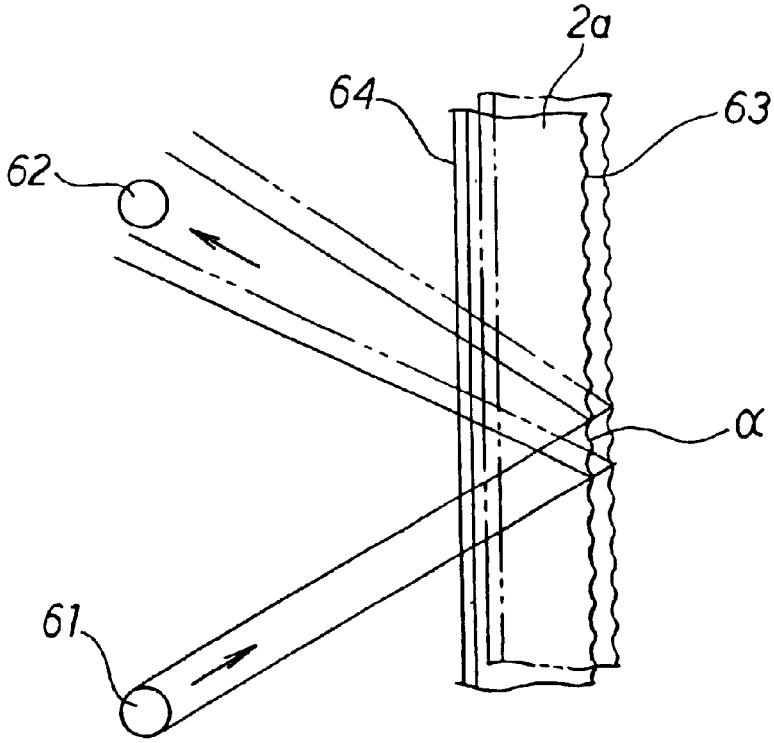
FIG. 16 is a horizontal cross-sectional view that conceptually diagrams the way light is reflected at the remaining ink quantity detection site.
Figure 17:
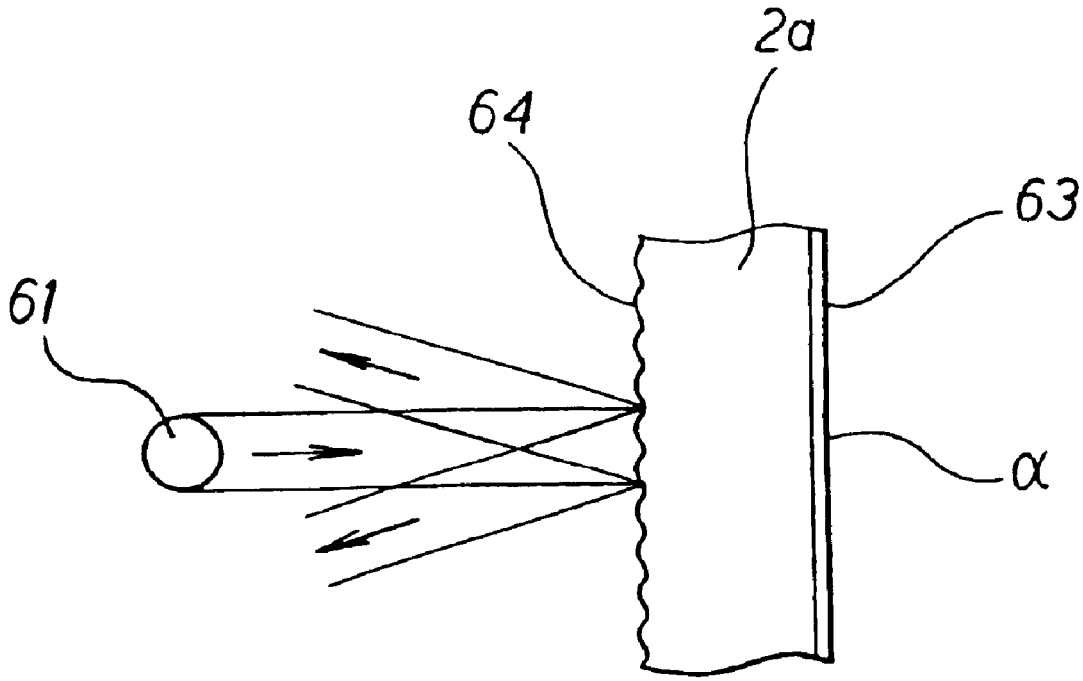
FIG. 17 is a vertical cross-sectional view that conceptually diagrams the way light is reflected at the remaining ink quantity detection site.

In a state wherein ink is present up to the height of the detection site α in the second chamber 10, the light emitted from the light emitting element 61 advances into the ink (arrow B) due to the refractive indexes of the side wall 2*a* and the ink, but advances almost not at all toward the light emitting element 62. In a state wherein ink is not present at the detection site α, light is reflected by the inner surface of the side wall 2*a* and advances toward the light emitting element 62. At this time, if many fine undulating ribs 63 are formed on the inner surface of the side wall 2*a* of the case 2, extending vertically up and down, then, as indicated by the solid lines in FIG. 15, the light emitted from the light emitting element 61, when reflected by the inner surface of the side wall 2*a* of the case 2, is scattered in a substantially horizontal direction (i.e. in a direction parallel to the plane containing the light emitting element 61, the light emitting element 62, and the detection site α) by the undulating ribs 63, and advances toward the light emitting element 62 while spreading out in the plane containing the light emitting element 61 and the light emitting element 62 of the sensor 60 and the detection site α on the case 2. The light reflected when no such undulating ribs are formed on the inner surface of the side wall 2*a* is indicated by the double-dotted lines in the same figure. Accordingly, as indicated by the solid lines and the double-dotted lines in FIG. 16, the light emitting element 62 can capture the reflected light in a definite way even when there are slight changes in the distance between the sensor 60 and the detection site α. In other words, even when variation in the sensor 60 attachment position relative to the carriage 52 arises during manufacture of the ink jet printer, or the ink cartridge 1 mounting position is shifted slightly when the user replaces the ink cartridge 1, the remaining ink quantity can be detected unambiguously. In the drawing, for convenience, the light is represented as being emitted from the light emitting element 61 in a parallel state, but the same benefit can be realized even if the light is emitted so that it spreads.

Furthermore, when many finely undulating ribs 64 are formed on the inner surface of the side wall 2*a* extending in a fore and aft direction, as described in the foregoing, the light that is reflected at the outer surface of the side wall 2*a* of the case 2 is scattered vertically upward and downward by the undulating ribs 64, and the light reflected at the outer surface of the side wall 2*a* proceeds toward the light emitting element 62 while spreading outside of the plane containing the light emitting element 61 and light emitting element 62 of the sensor 60 and the detection site α, wherefore it becomes difficult for the light emitting element 62 to capture that light that is reflected at the outer surface of the side wall 2*a* which does not contribute to the detection of the remaining ink quantity. That being so, of the reflected light that is captured by the light emitting element 62, the proportion of those components of the light reflected by the inner surface of the side wall 2*a* that do contribute to remaining ink quantity detection becomes high, whereupon remaining ink volume detection precision is enhanced. Hypothetically, in a case where the undulating ribs on the inner face of the side wall 2*a* extend in the horizontal direction, light would be scattered vertically up and down, wherefore, when the distance between the sensor 60 and the detection site α has changed, as diagrammed in FIG. 16, the allowable position whereat the light emitting element 62 can capture the reflected light would significantly more limited than in the embodiment described above.

The case 2 configured as described in the foregoing is formed in a die. In the die used for this purpose, the die face corresponding to the inner surface of the side wall 2*a* where the detection site α is established is polished in a direction perpendicular to the plane containing the light emitting element 61, the light emitting element 62, and the detection site α, and the die face corresponding to the outer surface of the side wall 2*a* where the detection site α is established is polished in a direction parallel to the plane containing the light emitting element 61, the light emitting element 62, and the detection site α. By subjecting the die faces to polishing in this manner, the many finely undulating ribs extending in the prescribed directions are formed on the two die faces, respectively. Accordingly, by using such a die as this, an ink cartridge 1 can be easily manufactured wherein many undulating ribs 63 and 64 are formed in the prescribed directions on the inner surface and outer surface, respectively, of the side wall 2*a* where the detection site α is established.

With this embodiment, moreover, the light emitting element 61 and the light emitting element 62 are positioned in a horizontal orientation, but this does not constitute a limitation, and it is possible to position the light emitting element 61 and the light emitting element 62 in the vertical dimension of the ink cartridge 1. In that case, however, the orientations of the undulating ribs 63 and 64 formed in the inside and outside surfaces of the side wall 2*a*, respectively, must be reversed.

The method of fabricating the ink cartridge 1 is described next. The case 2 is first molded out of resin, then washed and dried. At this time, both the upper and lower faces of the case 2 are open, wherefore the case 2 can be easily molded with a die that separates up and down. The case must be washed well so that the ink properties do not change, but, with this case shape, the washing liquid readily reaches into the interior portions, so washing can be done easily. Drying can also be performed so that no washing liquid remains.

As diagrammed in FIG. 4, the porous material 8 is inserted into the first chamber 9 from the upper open end of the case 2. This porous material 8 is accommodated in a compressed condition because the upper cover member 3 pushes against it. The upper cover member 3 is heat welded around the lip of the upper opening in the case 2 and at the upper ends of the partitioning walls 5 and 6. The lower cover member 4 is secured by heat welding around the lip of the lower opening in the case 2 and at the lower ends of the partitioning walls 7*a*, 7*b*, and 7*c*. To the ink supply hole 17 and atmosphere connection hole 18 in the lower cover member 4 is applied a sealing material 23, which can be peeled away, for covering them. Thus the top and bottom of the case 2 are formed in a substantially open condition. By mounting the cover members 3 and 4 from the top and bottom, the various types of chamber described earlier can be formed, making the assembly thereof easy. The ink supply hole 17 and the atmosphere connection hole 18 are lined up on one side of the cartridge, wherefore the sealing material 23 for covering these can be applied easily, without the need of being pulled around the outer periphery of the cartridge as conventionally.

Figure 18:
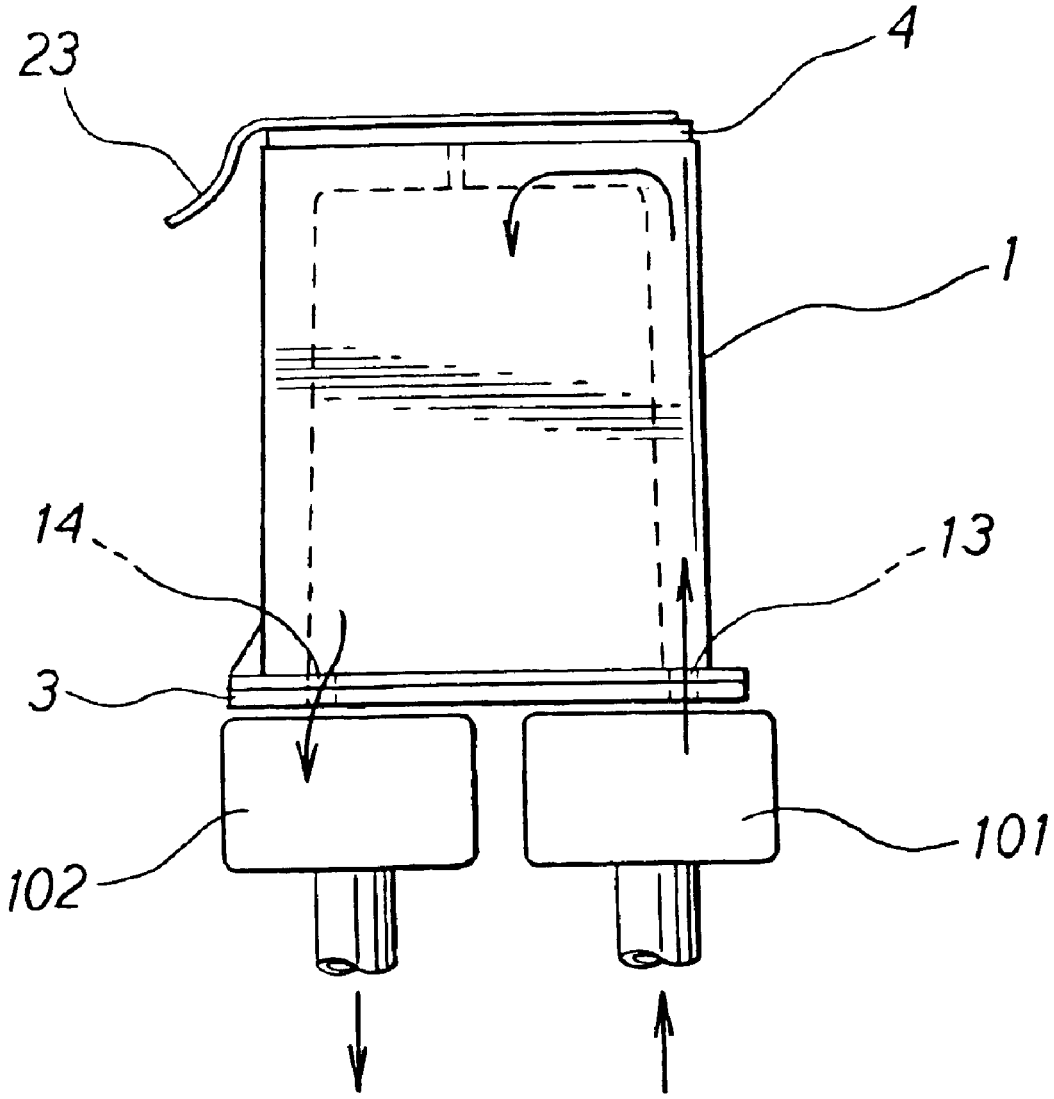
FIG. 18 is a diagram for explaining the ink cartridge ink filling operation.

The operation of filling the inside of the ink cartridge 1 with ink is next described. As diagrammed in FIG. 18, with the ink supply hole 17 and the atmosphere connection hole 18 in the lower cover member 4 sealed as described above, an ink filling apparatus 101 is tightly fitted to the ink filling hole 13 and a pressure reduction apparatus 102 is tightly fitted to the pressure reduction hole 14 in the upper cover member 3, as diagrammed in FIG. 18, and the apparatuses are activated. Because the ink filling hole 13 and the pressure reduction hole 14 are lined up on one side of the cartridge, the apparatuses need only be brought up against one side of the cartridge 1. The air inside the first chamber 9 is sucked out from the pressure reduction hole 14 prior to ink filling. The pressure in the first and second chambers 9 and 10 is thereby reduced, whereupon the ink passes from the ink filling hole 13 through the second chamber 10 and the connecting hole 15 and thus fills the porous material 8 inside the first chamber 9. When this is done, the second chamber 10 becomes an ink filling path. The ink enters the second chamber 10 from one end, passes through the connecting hole 15 that is maximally separated therefrom, and enters the first chamber 9, after which it reaches the pressure reduction hole 14 that is maximally separated from the connecting hole 15, wherefore the second chamber 10 itself can be completely filled with ink, while, at the same time, the first chamber 9 can also be efficiently filled with ink. Also, as described in the foregoing, the outside of the case 2 is a reinforced double-walled structure, wherefore the case 2 will not be deformed very much during pressure reduction, for which reason also the two chambers 9 and 10 can be efficiently filled with ink. The pressure in the atmosphere connection path 11 is also reduced simultaneously with the first chamber 9, and the reduced pressure state is maintained even after the sealing material is applied.

For the ink loaded by this process, ink (so-called deaerated ink) is used from which bubbles and air dissolved therein has been removed to the extent possible. The purpose of this is to avoid ink ejection problems that arise when bubbles and air penetrate into the recording head 72. And the ink cartridge is hermetically sealed under reduced pressure in the packaging bag 8, as described earlier, in order to prevent bubbles and air from again being dissolved in the deaerated ink.

After ink filling, sealing materials 21 and 22 are applied to the ink filling hole 13 and the pressure reduction hole 14. The sealing materials 21 and 22 may be applied in a single strip if, afterwards, only the necessary portions are left remaining. Thus, in the manufacturing stage, the filling apparatus 101 and the pressure reduction apparatus 102 need only be brought up against the case 2 from one side, and the seals need be only applied from one side of the case 2 also, making for efficient operations.

The ink cartridge 1 fabricated in this manner is shipped after being hermetically sealed under reduced pressure inside the packaging bag 81, as described earlier.

When the ink cartridge 1 is used by the user, the user peels away the sealing material 23 applied to the ink supply hole 17 and the atmosphere connection hole 18 of the ink cartridge 1, and couples the ink supply hole 17 via the joint member 74 to the manifold 73 in the recording head 72. Then a suction cap is connected to the recording head 72 and the recording head 72 is filled with ink from the ink cartridge 1, as is commonly known.

During a recording operation, due to the suction force of the porous material 8 inside the first chamber 9, that is, due to capillary action, a negative pressure is caused to act on the ink supplied to the recording head from the second chamber 10. The actuators in the recording head 72 perform an ink ejecting action, thereby producing a negative pressure in the ejection direction and drawing out ink from the ink cartridge 1. When the ink in the second chamber 10 flows out from the ink supply hole 17, ink is replenished in the second chamber 10 from the porous material 8 in the first chamber 9, and air is inducted from the atmosphere connection hole 18 through the atmosphere connection path 11 into the first chamber 9 as the ink in the first chamber 9 is consumed. The upper end of the second chamber 10 is sealed by the sealing material 21. Therefore, because the second chamber 10 completely filled with ink, atmospheric pressure does not act on the ink in the second chamber 10, wherefore the ink in the second chamber 10 will be consumed after the ink in the first chamber 9 is almost completely depleted. In other words, when the ink in the first chamber 9 is gone, due to the pressure of the recording head 72 drawing the ink, the ink in the second chamber 10 is consumed while air from the first chamber 9 enters the second chamber 10, whereupon a gap develops at the top of the vertical part of the second chamber 10 and the ink liquid level therein begins to fall.

Thus, in the first chamber 9, atmospheric air is drawn in from the side distant from the connecting hole 15, so that not only is the ink in the first chamber 9 utilized effectively, but all of the ink, including the ink that is in the second chamber 10, is used effectively. Also, because the second chamber 10 is completely filled from the beginning as an ink filling path, during remaining ink quantity detection, detection errors will not be made due to inadequate ink filling here. The operation of removing the sealing material 23 is also easy because it is done only on one side of the cartridge.

As described in the foregoing, furthermore, there is a gap 31 between the connecting hole 15 and the ink supply hole 17, wherefore, when ink is drawn from the first chamber 9 through the connecting hole 15 into the second chamber 10 by the pressure caused by the recording head 72 sucking ink, when air bubbles are mixed into that ink, or the ink in the first chamber 9 is consumed so that air is drawn into the second chamber 10 as described earlier, those bubbles and air can be blocked from flowing into the recording head 72. In other words, when the ink flow detours around the baffle plate 31, as indicated by the arrow 32 in FIG. 6, in the vicinity corresponding to the vertical part 10*a* of the second chamber 10, the air and bubbles travel toward the top of the vertical part 10*a* due to buoyancy, and hence do not reach the ink supply hole 17. The ceiling surface of the horizontal part 10*b* of the second chamber 10, that is, the lower surface 7*d* of the bottom partitioning wall 7, is inclined so that it rises from the lower end of the connecting hole 15 toward the vertical part 10*a* of the second chamber 10, wherefore air and bubbles do not become trapped at the lower surface of the bottom partitioning wall 7 but rather flow toward the top of the vertical part 10*a*. That being so, bubbles and air can be prevented from penetrating to the recording head 72 and causing ink ejection failures.

What is claimed is:

1. An ink cartridge, comprising:

a case in which an ink chamber and an atmosphere connection path are formed, the atmosphere connection path connecting the ink chamber with the outside of the case;

a through hole formed in the atmosphere connection path, the through hole passes from a first end surface to a second end surface opposite the first end surface, wherein the first end surface faces upward and the first end surface is above the second end surface; and an ink sump positioned lower than the first end surface of the through hole, wherein the through hole is formed midway along the atmosphere connection path.

2. The ink cartridge according to claim 1, wherein the through hole and the ink sump are formed at a partitioning wall that extends so that there is a difference in height between the through hole and the ink sump, the partitioning wall partitions the atmosphere connection path into an upper part and a lower part and the through hole is formed at a high portion of the partitioning wall.

3. The ink cartridge according to claim 1, wherein the through hole and the ink sump are formed at a lower cover of the case, the lower cover having a peripheral wall projecting upward and the through hole penetrates the peripheral wall.

4. An ink cartridge, comprising:

a case having a side wall, a first partitioning wall extending substantially parallel to the side wall for separating the interior of the case into an ink chamber and an atmosphere connection path, the atmosphere connection path connecting the ink chamber with an outside of the case;

a second partitioning wall that partitions the atmosphere connection path into an upper portion and a lower portion; and a wall covering the ink chamber and the upper portion with a path formed to communicate the ink chamber to the upper portion of the atmosphere connection path, wherein the second partitioning wall further includes a through hole having an end surface that faces upward and an ink sump positioned lower that the end surface of the through hole.

5. An ink cartridge, comprising:

an ink chamber that holds ink;

a connection path that communicates the ink chamber with an outside of the ink cartridge; and an ink sump formed in the connection path that first collects ink that passes from the ink chamber to the connection path and is at a predetermined distance away from a connection between the ink chamber and the connection path, wherein a through hole and the ink sump are formed at a wall that extends so that there is a difference in height between the through hole and the ink sump and such that some of the ink that passes from the ink chamber to the connection path is collected by the ink sump before passing through the through hole.

6. The ink cartridge according to claim 5, wherein the wall is a partitioning wall that partitions the connection path into an upper part and a lower part and the through hole is formed at a high portion of the partitioning wall.

7. The ink cartridge according to claim 5, wherein the ink sump partitions the connection path into an upper part and a lower part.

8. The ink cartridge according to claim 5, wherein the ink sump is formed vertically midway along the connection path.

9. The ink cartridge according to claim 5, further comprising:

a case having the ink chamber, the connection path and the ink sump, wherein the ink sump is formed at a lower cover of the case, the lower cover having a peripheral wall projecting upward as the wall and the through hole penetrating the peripheral wall and positioned higher than the ink sump.

10. An ink cartridge, comprising:

an ink chamber that holds ink;

a connection path that communicates the ink chamber with an outside of the ink cartridge;

an ink sump formed in the connection path a predetermined distance away from a connection between the ink chamber and the connection path; and a case having the ink chamber, the connection path and the ink sump, wherein the ink sump is formed at a lower cover of the case, the lower cover having a peripheral wall projecting upward and a through hole penetrating the peripheral wall and positioned higher than the ink sump.

11. An ink cartridge, comprising:

a case in which an ink chamber and an atmosphere connection path are formed, the atmosphere connection path connecting the ink chamber with the outside of the case;

a first through hole formed in the atmosphere connection path, the first through hole passes from a first end surface to a second end surface opposite the first end surface, wherein the first end surface faces upward and the first end surface is above the second end surface;

an ink sump positioned lower than the first end surface of the first through hole; and a second through hole formed at an end of the atmosphere connection path at a downstream side of the first through hole, wherein the second through hole directly communicates with the outside of the case.

* * * * *